US008377620B2

(12) United States Patent
Nagatomo et al.

(10) Patent No.: US 8,377,620 B2
(45) Date of Patent: Feb. 19, 2013

(54) IMAGE FORMING APPARATUS, IMAGE FORMING METHOD, AND TONER FOR IMAGE FORMING APPARATUS

(75) Inventors: Tsuneyasu Nagatomo, Numazu (JP); Toyoshi Sawada, Hiratsuka (JP); Satoshi Kojima, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 845 days.

(21) Appl. No.: 12/276,827

(22) Filed: Nov. 24, 2008

(65) Prior Publication Data

US 2009/0142685 A1 Jun. 4, 2009

(30) Foreign Application Priority Data

Nov. 30, 2007 (JP) ..... 2007-311280
Oct. 7, 2008 (JP) ..... 2008-260335

(51) Int. Cl.
*G03G 21/10* (2006.01)

(52) U.S. Cl. ..... 430/126.2; 430/108.6; 430/108.7

(58) Field of Classification Search ..... 430/126.2, 430/108.6, 108.7
See application file for complete search history.

(56) References Cited

U.S. PATENT DOCUMENTS 6,363,237 B1 * 3/2002 Nagame et al. ..... 399/343
6,534,230 B1 * 3/2003 Blair et al. ..... 430/108.24
6,566,026 B2 5/2003 Watanabe et al.
6,653,033 B1 * 11/2003 Kami et al. ..... 430/58.05
6,653,037 B2 11/2003 Sawada et al.
6,716,561 B2 4/2004 Shiraishi et al.
6,821,698 B2 11/2004 Sawada et al.
6,852,459 B2 2/2005 Katoh et al.
6,939,653 B2 9/2005 Suzuki et al.
7,049,037 B2 5/2006 Katoh et al.
7,052,815 B2 5/2006 Sawada et al.
7,060,407 B2 6/2006 Nagayama et al.
7,067,225 B2 * 6/2006 Watanabe et al. ..... 430/123.51
7,132,210 B2 11/2006 Suzuki et al.
7,163,774 B2 1/2007 Shiraishi et al.
7,217,485 B2 5/2007 Hasegawa et al.
7,250,243 B2 * 7/2007 Lee et al. ..... 430/108.6
7,379,696 B2 5/2008 Sawada et al.
7,383,013 B2 * 6/2008 Watanabe et al. ..... 399/354
7,386,266 B2 6/2008 Nagayama et al.
7,413,839 B2 8/2008 Matsumoto et al.
7,695,882 B2 * 4/2010 Broce et al. ..... 430/108.6
7,767,370 B2 * 8/2010 Ishigami et al. ..... 430/45.51
2003/0165761 A1 * 9/2003 Arai et al. ..... 430/108.6
2004/0170913 A1 * 9/2004 Lee et al. ..... 430/108.6
2006/0063081 A1 3/2006 Nagatomo et al.
2006/0222987 A1 10/2006 Suzuki et al.
2007/0218383 A1 9/2007 Seshita et al.
2007/0242992 A1 * 10/2007 Watanabe et al. ..... 399/354
2008/0107986 A1 * 5/2008 Michel et al. ..... 430/84

FOREIGN PATENT DOCUMENTS

JP 2004-246057 9/2004
WO WO 2005111729 A2 * 11/2005

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*
English language machine translation of KR 2002-0061682 (Jul. 2002).*

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

An image forming method including charging an image bearing member by applying combination of DC voltage and AC voltage with frequency of 6.5 to 8.5 cycle/mm; irradiating the image bearing member with light to form an electrostatic image; developing the electrostatic image with a developer including toner to form a toner image; transferring the toner image onto a receiving material; fixing the toner image; cleaning the image bearing member with a blade; then applying a lubricant to the image bearing member; and then spreading the lubricant with a spreading member countering the image bearing member. The toner includes toner particles granulated in an aqueous medium; and at least three kinds of external additives including a first particulate hydrophobic silica, a particulate hydrophobic titanium oxide and a second particulate hydrophobic silica respectively having BET specific surface areas of 20 to 40 $m^2/g$, 40 to 80 $m^2/g$, and 130 to 300 $m^2/g$.

7 Claims, 5 Drawing Sheets

IMAGE FORMING APPARATUS, IMAGE FORMING METHOD, AND TONER FOR IMAGE FORMING APPARATUS

BACKGROUND OF THE INVENTION

1. Field of the Invention

The present invention relates to an image forming method and apparatus, which form images using a recording technology such as electrophotography and electrostatography. In addition, the present invention relates to toner for use in image forming apparatus.

2. Discussion of the Background

Electrophotographic image forming apparatus typically perform the following image forming processes.

(1) Charging a surface (i.e., an image forming area) of an image bearing member such as photoreceptors (charging process):

(2) Irradiating the charged image bearing member with light to form an electrostatic latent image on the image bearing member (light irradiation process);

(3) Developing the electrostatic latent image with a developer including a toner to form a toner image on the image bearing member (development process);

(4) Transferring the toner image onto a receiving material fed from a sheet feeding device optionally via an intermediate transfer medium (transfer process);

(5) Fixing the toner image to the receiving material upon application of heat and pressure thereto (fixing process); and (6) Removing toner particles remaining on the image bearing member and intermediate transfer medium without being transferred so that the image bearing member and intermediate transfer medium are ready for the next image forming processes (cleaning process).

Charging methods for charging an image bearing member are broadly classified into DC charging methods in which a DC voltage is applied to an image bearing member, and AC charging methods in which a DC voltage on which an AC voltage is superimposed is applied to an image bearing member.

Since AC charging methods have advantages such that the image bearing members can be uniformly charged and the potentials of the charged image bearing members can be easily controlled, the AC charging methods are broadly used for low-speed or medium-speed electrophotographic image forming apparatus. Charging rollers are typically used as the charging member. The charging methods using a charging roller are hereinafter referred to as AC roller charging methods. Among the AC roller charging methods, short-range AC roller charging methods, in which a charging roller arranged in the vicinity of an image bearing member with a small gap therebetween is used for charging an image bearing member, are broadly used particularly for durable-use image forming apparatus attaching importance to durability. This is because the degree of contamination of the charging rollers used therefor is smaller than that of charging rollers used for contact roller charging methods, resulting in improvement of durability of the charging rollers.

In AC roller charging methods, at least a certain number of electric discharges have to be performed per unit length in the sub-scanning direction in order to uniformly charge the image bearing member. In general, the frequency of the AC voltage is set to be from 6.0 to 7.3 cycles per millimeter.

Since AC charging methods repeat negative and positive electric discharges, the AC charging methods expose the image bearing members to relatively serious hazards compared to DC roller charging methods and corona charging methods. Specifically, AC charging methods tend to easily cause problems in that the surface of the image bearing members (such as photoreceptors) is abraded, and/or foreign materials such as toner particles and dust of paper sheets used as a receiving material are adhered to the surface of the image bearing members, resulting in formation of a film (such as toner film) on the surface of the image bearing members (hereinafter referred to as a filming problem), thereby deteriorating image qualities. This is a drawback of the AC charging methods. These problems are typically caused when the image forming apparatus are high speed image forming apparatus, or large-size image forming apparatus capable of forming images with an A3 size or a size slightly greater than A3 size. The reason therefor is that in these image forming apparatus, the diameter of the charging roller is larger (i.e., the curvature of the charging roller is smaller) than that in low speed image forming apparatus, and therefore the discharge area of the charging roller increases, resulting in increase of the risk of AC charging problems. In order to further improve the image qualities and to uniformly charging image bearing members, the AC frequency is preferably from 7.5 to 8.0 cycle/mm.

For the reason mentioned above, high speed image forming apparatus with a linear speed of 250 mm/s or more hardly use an AC roller charging method. However, there are some high speed image forming apparatus using an AC roller charging method. Such image forming apparatus use a short-range charging method, and therefore the charging roller has good resistance to contamination, i.e., the charging roller has a relatively long life. However, the gap between the charging roller and the image bearing member increases in such image forming apparatus, thereby increasing the risk of the filming problem. In attempting to prevent occurrence of the filming problem, a lubricant such as zinc stearate is coated on the surface of the image bearing member. Therefore, a large-size lubricant has to be set in the image forming apparatus to lengthen the life of the image bearing member, resulting in jumboization of the image forming apparatus.

Toners prepared by a pulverization method including kneading toner components such as binder resins, colorants (pigments), charge controlling agents, and release agents while heating; cooling the kneaded mixture; pulverizing the kneaded mixture; and then classifying the pulverized mixture, have been typically used for image forming apparatus. However, it is difficult for such a pulverization method to control the particle diameter and shapes of the toner particles. In attempting to control the particle diameter and shapes of toner particles, polymerization methods (such as emulsion polymerization methods, and solution dispersing methods) in which toner particles are prepared in an aqueous medium have been actively developed and used.

In addition, a particulate material having an average particle diameter of from 5 to 25 nm is added as an external additive to toner particles, followed by mixing to improve the fluidity and chargeability of the toner. For example, techniques such that silica or titanium dioxide is added as an external additive to toner to improve the fluidity of the toner have been proposed. In addition, techniques such that an external additive whose surface is treated with an organic silicon compound such as silane and silicone oils to improve the hydrophobicity and chargeability of the toner have been proposed. Further, techniques such that a titanium oxide having a low electric resistance is used as an external additive have been proposed.

However, when the toner having such an external additive thereon is mixed with a carrier to be used for a two-component developer, a problem in that the external additive is embedded into toner particles when receiving stress from the carrier, resulting in deterioration of the fluidity of the toner tends to occur. In attempting to prevent occurrence of the problem, it is effective to add a combination of an external additive having a relatively small particle diameter and another external additive having a relatively large particle diameter. However, the larger external additive is easily released from toner particles, and thereby the smaller external additive is embedded into the toner particles, resulting in deterioration of the fluidity of the toner. In this case, problems which occur are that image density decreases; and developing properties of the developer are changed due to the larger external additive released from the toner and remaining in the developer, resulting in occurrence of background development in which the background areas of images are soiled with toner particles.

In addition, it is well known that when an external additive released from toner particles is adhered to carrier particles, the chargeability of the carrier deteriorates depending on the properties of the external additive. In this regard, it is known that when the external additive has a low electric resistance, the charging ability of the carrier seriously deteriorates. Further, an external additive having a relatively large particle diameter and released from toner particles tends to easily form a film on the image bearing member (such as photoreceptors). In this case, blurred images are formed particularly under high temperature and high humidity conditions. In attempting to prevent an external additive having a relatively large particle diameter from being released from toner particles, several techniques have been proposed. For example, Japanese patent application publication No. 2004-246057 discloses a method in which a particulate resin having a relatively large particle diameter is mixed with toner particles for 2 minutes using a hybridization system, in which the rotor is rotated at a revolution of 12000 rpm. According to the present inventors' study, it is found that the charge properties of the toner particles to which such a particulate resin is fixed by this method deteriorate.

Because of these reasons, a need exists for a high speed image forming apparatus, which uses a non-contact AC roller charging method and which can stably produce high quality images over a long period of time without causing the filming problem and the problem in that the chargeability of the carrier deteriorates due to the released external additive.

SUMMARY OF THE INVENTION

As an aspect of the present invention, an image forming method is provided, which includes:

charging an image bearing member with a non-contact AC charging member applying a combination of a DC voltage and an AC voltage with a frequency of from 6.5 to 8.5 cycle/mm;

irradiating the charged image bearing member with light to form an electrostatic latent image on the image bearing member;

developing the electrostatic latent image with a developer including a toner to form a toner image on the image bearing member;

transferring the toner image onto a receiving material optionally via an intermediate transfer medium;

fixing the toner image on the receiving material;

cleaning a surface of the image bearing member with a blade;

applying a lubricant to the surface of the image bearing member after cleaning the image bearing member; and spreading the lubricant on the surface of the image bearing member with a spreading member which is set on the image bearing member so as to counter the image bearing member, wherein the toner includes:

toner particles, which are granulated in an aqueous medium; and at least three kinds of external additives, which are present on the surface of the toner particles and include:

a first particulate hydrophobic silica having a BET specific surface area of from 20 to 40 $m^2/g$;

a particulate hydrophobic titanium oxide having a BET specific surface area of from 40 to 80 $m^2/g$; and a second particulate hydrophobic silica having a BET specific surface area of from 130 to 300 $m^2/g$.

As another aspect of the present invention, an image forming apparatus is provided, which includes:

A rotatable image bearing member;

a charging device configured to charge the image bearing member with a non-contact AC charging member configured to apply a combination of a DC voltage and an AC voltage with a frequency of from 6.5 to 8.5 cycle/mm;

a light irradiating device configured to irradiate the charged image bearing member with light to form an electrostatic latent image on the image bearing member;

a developing device configured to develop the electrostatic latent image with a developer including a toner to form a toner image on the image bearing member;

a transfer device configured to transfer the toner image onto a receiving material optionally via an intermediate transfer medium;

a fixing device configured to fix the toner image on the receiving material;

a cleaning device configured to clean a surface of the image bearing member with a blade;

a lubricant applying device configured to apply a lubricant to the surface of the image bearing member after cleaning the image bearing member; and a lubricant spreading device configured to spread the lubricant on the surface of the image bearing member with a spreading member which is set on the image bearing member so as to counter the image bearing member, wherein the toner is the toner mentioned above.

The image bearing member is preferably rotated at a linear speed of not lower than 300 mm/sec.

As yet another aspect of the present invention, a toner is provided, which includes:

toner particles, which are granulated in an aqueous medium; and at least three kinds of external additives, which are present on the surface of the toner particles and include:

a first particulate hydrophobic silica having a BET specific surface area of from 20 to 40 $m^2/g$;

a particulate hydrophobic titanium oxide having a BET specific surface area of from 40 to 80 $m^2/g$; and a second particulate hydrophobic silica having a BET specific surface area of from 130 to 300 $m^2/g$.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
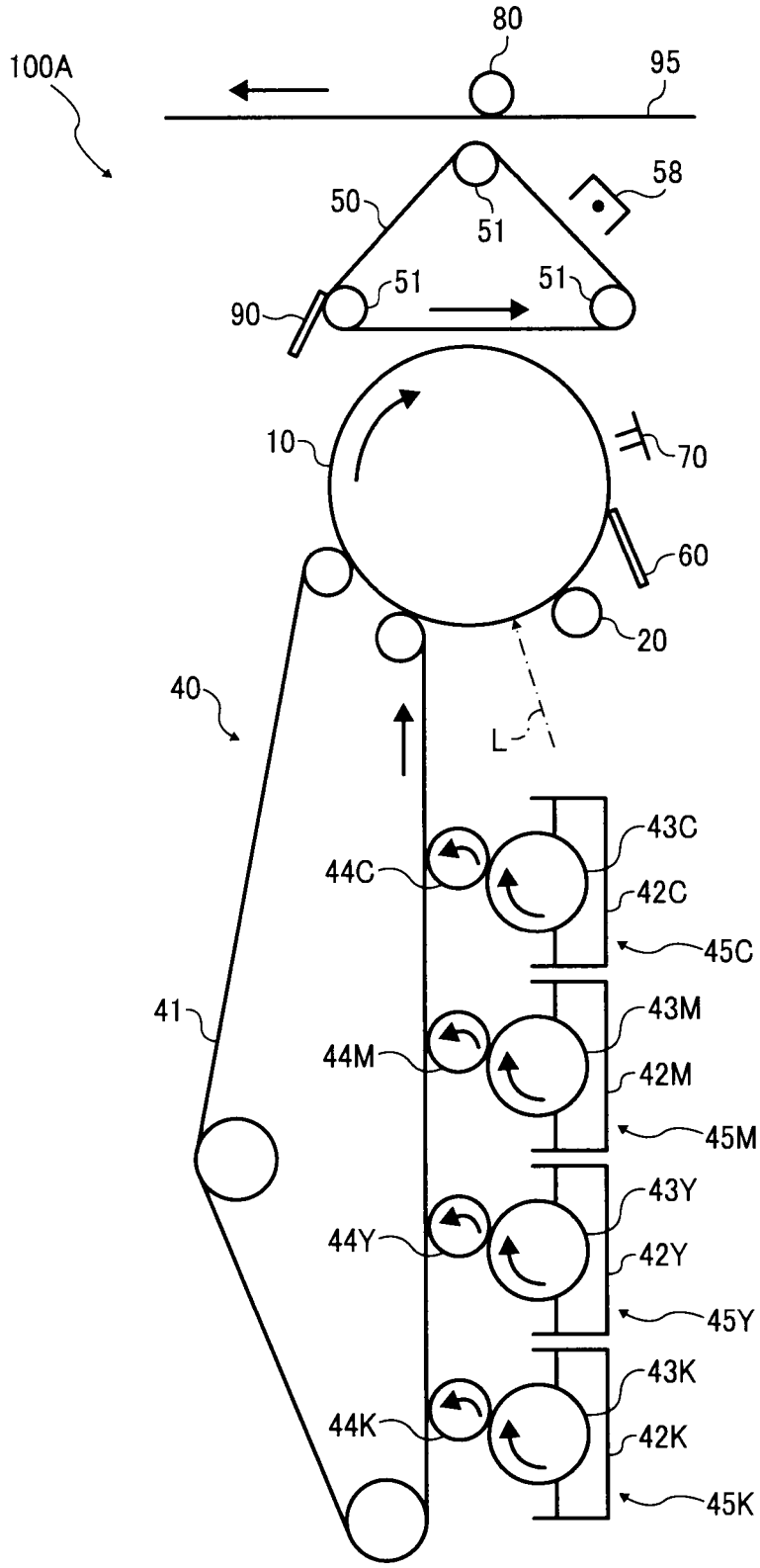
FIG. 1 is a schematic view illustrating an example of the image forming apparatus of the present invention.

The present inventors have studied the above-mentioned problem to be solved. As a result of the study, the following is discovered.

Specifically, when the frequency of AC voltage in an AC roller charging method is high, possibility of occurrence of the filming problem increases, but the charge uniformity is enhanced. In contrast, when the frequency of AC voltage is too low, damage of the image bearing member is little but image qualities deteriorate. The present inventors discover that by decreasing the frequency of AC voltage to the lower limit range without deteriorating the image qualities, it becomes possible to prevent occurrence of the filming problem. Thus, high quality images can be produced while preventing occurrence of the filming problem.

In addition, the filming problem is mainly caused by a relatively large external additive (having a BET specific surface area of from 20 to 40 $m^2/g$) added to the toner to be adhered to the surface of the toner. Namely, the filming problem is caused depending on the adhesiveness of such a relatively large external additive to the toner. The present inventors discover that a toner, which is prepared by firstly adhering such a relatively large external additive to the toner particles such that the external additive is strongly adhered to the toner particles, hardly causes the filming problem even when used for a high-frequency AC roller charging method, and thereby high quality images can be produced.

In addition, it is discovered that a particulate titanium oxide having a low electric resistance tends to be released from toner particles, and the released titanium oxide tends to be adhered to carrier particles, resulting in deterioration of chargeability of the carrier. Therefore, it is preferable to reduce the amount of released titanium oxide. It is discovered that by adding a titanium oxide before adding a particulate hydrophobic silica, which has a relatively small particle diameter and which can impart good fluidity to the toner, adhesiveness of the titanium oxide to the toner can be enhanced. By using this technique, deterioration of chargeability of the carrier and scattering of the toner can be prevented and high quality images can be stably produced over a long period of time.

Further, it is found that by performing a lubricant application process, which is conventionally performed before a cleaning process using a blade, on the image bearing member after a cleaning process, and then performing a lubricant spreading process, the life of the image bearing member can be prolonged while reducing the amount of consumption of the lubricant to one fourth. This is because toner particles, released external additives, and deteriorated lubricant, which remain on the surface of the image bearing member even after an image transfer process, have been removed therefrom, and therefore the effect of the lubricant can be produced even when a small amount of lubricant is applied on the cleaned surface of the image bearing member.

The present invention will be explained in detail.

(Toner)

The toner of the present invention includes toner particles, and at least three kinds of external additives externally added to the toner particles so as to be adhered to the surface of the toner particles. The toner particles are prepared by dispersing or emulsifying an oil phase liquid (or a monomer liquid) including toner components optionally including a toner component precursor (such as a binder resin precursors (e.g., prepolymers mentioned below) in an aqueous medium. Hereinafter the oil phase liquid or a monomer liquid is referred to as a toner component liquid. The toner component liquid includes at least a binder resin, a colorant, and a layered inorganic material in which at least part of interlayer ions present between layers is modified with an organic cation. It is preferable that the toner component liquid further includes a binder resin precursor, and a compound capable of inducing a polymer chain growth reaction and/or a crosslinking reaction with the binder resin precursor.

Next, the toner components will be explained in detail.

(Modified Layered Inorganic Material)

At first, modified layered inorganic materials in which at least part of interlayer ions is modified with an organic ion and which are used for toner particles of the toner of the present invention will be explained.

Layered inorganic materials are defined as inorganic minerals in which layers having a thickness of few nanometers are overlaid. Modifying the inorganic materials with an organic ion means that one or more organic ions are incorporated as interlayer ions. This is called intercalation. Specific examples of the layered inorganic materials include smectite family (e.g., montmorillonite and saponite), kaolin family (e.g., kaolinite), magadiite, and kanemite. Because of having a layered structure, the layered inorganic materials have good hydrophilicity. When such an unmodified layered inorganic material is included in a toner component liquid and the toner component liquid is dispersed in an aqueous medium to prepare toner particles, the unmodified layered inorganic material is migrated into the aqueous medium, and thereby deformed toner particles cannot be formed (i.e., spherical toner particles are formed and toner particles having forms other than spherical form cannot be prepared). When modified layered inorganic materials, which have a greater hydrophobicity (less hydrophilicity) than unmodified layered inorganic materials, are used, the materials form relatively fine toner particles with forms other than the spherical form in a granulation process (i.e., a toner particle preparation process). In addition, the materials tend to be present in a surface portion of the resultant toner particles, and thereby a good charge controlling function of the modified layered inorganic material can be imparted to the toner. Further, the modified layered inorganic materials impart a good low temperature fixability to the toner particles. The added amount of such a modified layered inorganic material in the toner component liquid is preferably from 0.05 to 5% by weight based on the total weight of the solid components included in the toner component liquid.

The modified layered inorganic materials for use in the toner of the present invention are preferably layered inorganic materials having a smectite crystal form and modified by an organic cation. In addition, it is preferable to replace part of divalent metal ions of the layered inorganic materials with a trivalent metal ion to incorporate a metal anion in the layered inorganic materials. In this regard, the metal-anion-incorporated layered inorganic materials have high hydrophilicity, and therefore it is preferable to replace at least part of the metal anions with an organic anion.

Suitable organic compounds for use in incorporating organic ions in layered inorganic materials include quaternary alkyl ammonium salts, phosphonium salts, imidazolium salts, etc. Among these compounds, quaternary alkyl ammonium salts are preferable. Specific examples of the quaternary alkyl ammonium salts include trimethylstearyl ammonium, dimethylstearylbenzyl ammonium, oleylbis(2-hydroxyethyl) methyl ammonium, etc.

Specific examples of other organic compounds for use in incorporating organic ions in layered inorganic materials include sulfates, sulphonates, carboxylates,and phosphates having a group (or a structure) such as linear, branched or cyclic alkyl groups (C1-C44), alkenyl groups (C1-C22), alkoxyl groups (C8-C32), hydroxyalkyl groups (C2-C22), ethylene oxide structure, and propylene oxide structure. Among these compounds, carboxylic acids having an ethylene oxide structure are preferably used.

When at least part of interlayer ions of layered inorganic materials is modified with one or more organic ions, the modified layered inorganic materials have proper hydrophobicity. By including such modified layered inorganic materials in a toner component liquid, the toner component liquid has a non-Newtonian viscosity, and thereby deformed toner particles can be prepared. As mentioned above, the added amount of a modified layered inorganic material in the toner component liquid is preferably from 0.05 to 5% by weight, based on the total weight of the solid components included in the toner component liquid. Modified versions of montmorillonite, bentonite, hectolite, hectorite, attapulgite, sepiolite, and mixtures of these materials are preferably used as modified layered inorganic materials. Among these materials, modified montmorillonite and bentonite are preferably used because the modified layered inorganic materials can easily adjust the viscosity of a toner component liquid even in a small added amount without deteriorating the properties of the resultant toner.

Specific examples of the marketed products of organic-cation-modified layered inorganic materials include quaternium 18 bentonite such as BENTONE 3, BENTONE 38, BENTONE 38V, (from Elementis Specialties), THIXOGEL VP (from United Catalyst), CLAYTON 34, CLAYTON 40, and CLAYTON XL (from Southern Clay Products); stearalkonium bentonite such as BENTONE 27 (from Elementis Specialties), THIXOGEL LG (from United Catalyst), CLAYTON AF and CLAYTON APA (from Southern Clay Products); quaternium 18/benzalkonium bentonite such as CLAYTON HT and CLAYTON PS (from Southern Clay Products), etc. Among these materials, CLAYTON AF and CLAYTON APA are preferably used.

Specific examples of the marketed products of organic-anion-modified layered inorganic materials include materials which are prepared by modifying DHT-4A (from Kyowa Chemical Industry Co., Ltd.) with a material having the following formula (1) (such as HITENOL 330T from Dai-ichi Kogyo Seiyaku Co., Ltd.).

$$R_1(OR_2)_nOSO_3M \quad (1)$$

wherein $R_1$ represents an alkyl group having 13 carbon atoms; $R_2$ represents an alkylene group having 2 to 6 carbon atoms; n is an integer of from 2 to 10, and M represents a monovalent metal element.

By using a modified layered inorganic material, which has proper hydrophobicity, the resultant toner component liquid can have a non-Newtonian viscosity, and thereby deformed toner particles can be formed.

(Binder Resin)

It is preferable that the toner particles of the toner of the present invention are prepared by dispersing or emulsifying a toner component liquid including at least a binder resin, a colorant, and a modified layered inorganic material in an aqueous medium. It is more preferable that the toner particles are prepared by dissolving or dispersing toner components including at least a first binder resin, a binder resin precursor, a compound capable of inducing a polymer chain growth reaction and/or a crosslinking reaction with the binder resin precursor, a colorant, and a modified layered inorganic material in an organic solvent to prepared a toner component liquid; and then subjecting the toner component liquid to a polymer chain growth reaction and/or a crosslinking reaction in an aqueous medium to prepare a dispersion, followed by removal of the organic solvent from the dispersion. The toner component may further include a release agent.

Suitable materials for use as the binder resin precursor include reactive modified polyester resins (RMPE), which are modified so as to have a group reactive with an active hydrogen atom. For example, polyester prepolymers (A) having an isocyanate group can be preferably used as reactive modified polyester resins. Polyester prepolymers having an isocyanate group can be prepared by reacting a polycondensation product of a polyol (PO) and a polycarboxylic acid (PC) (i.e., a polyester resin having a group including an active hydrogen atom) with a polyisocyanate (PIC). Specific examples of the group including an active hydrogen atom include hydroxyl groups (alcoholic hydroxyl groups and phenolic hydroxyl groups), amino groups, carboxyl groups, mercapto groups, etc. Among these groups, the alcoholic hydroxyl groups are preferable.

Suitable materials for use as the crosslinking agent for crosslinking the reactive modified polyester resins include amines. Amines mentioned later in detail serve as a crosslinking agent and a polymer chain growing agent for modified polyester resins reactive with an active hydrogen atom.

Modified polyester resins such as urea-modified polyester resins, which can be prepared by reacting a polyester prepolymer (A) having an isocyanate group with an amine (B), can be preferably used for the toner of the present invention. This is because the molecular weight of the polyester resins can be easily controlled, and good low temperature fixability and good releasability can be imparted to the resultant toner.

Suitable polyester prepolymers for use as binder resin precursors for preparing toner particles of the toner of the present invention include polyester prepolymers, which can be prepared by incorporating a functional group (such as isocyanate groups) reactive with active hydrogen in a polyester having a group (such as hydroxyl groups) having an active hydrogen atom. Modified polyester resins (MPE) (such as urea-modified polyester resins) can be prepared from the polyester prepolymers. When preparing the toner particles of the toner of the present invention, it is preferable to use a urea-modified polyester resin, which is prepared by reacting such a polyester prepolymer (A) having an isocyanate group with an amine (B) serving as a crosslinking agent and/or a polymer chain growing agent. The method for preparing a polyester prepolymer (A) having an isocyanate group is mentioned above.

Suitable polyols (PO) for use in preparing polyester prepolymers (A) include diols (DIO), polyols (TO) having three or more hydroxyl groups, and mixtures of DIO and TO. Preferably, diols (DIO) alone or mixtures of a diol (DIO) with a small amount of polyol (TO) are used.

Specific examples of the diols (DIO) include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and alkylene oxide adducts of bisphenols are preferable. More preferably, alkylene oxide adducts of bisphenols, and mixtures of an alkylene oxide adduct of a bisphenol and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

Suitable polycarboxylic acids (PC) for use in preparing the polyester prepolymer (A) include dicarboxylic acids (DIC) and polycarboxylic acids (TC) having three or more carboxyl groups. Preferably, dicarboxylic acids (DIC) alone and mixtures of a dicarboxylic acid (DIC) with a small amount of polycarboxylic acid (TC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

When a polycarboxylic acid (PC) is reacted with a polyol (PO), anhydrides or lower alkyl esters (e.g., methyl esters, ethyl esters or isopropyl esters) of the polycarboxylic acids mentioned above can also be used as the polycarboxylic acids (PC).

Suitable mixing ratio of a polyol (PO) to a polycarboxylic acid (PC) (i.e., the equivalence ratio [OH]/[COOH]) of the [OH] group of a polyol (PO) to the [COOH] group of a polycarboxylic acid (PC)) is from 2/1 to 1/1, preferably from 1.5/1 to 1/1 and more preferably from 1.3/1 to 1.02/1.

Specific examples of the polyisocyanates (PIC) for use in preparing the modified polyester resin include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., α,α,α',α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio of a polyisocyanate (PIC) to a polyester (i.e., the equivalence ratio [NCO]/[OH]) of the [NCO] group of a polyisocyanate (PIC) to the [OH] group of a polyester) is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner.

The content of the polyisocyanate unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the resultant toner. In contrast, when the content is too high, the low temperature fixability of the toner deteriorates.

The average number of the isocyanate group included in a molecule of the polyester prepolymer (A) is generally not less than 1, preferably from 1.5 to 3, and more preferably from 1.8 to 2.5. When the average number of the isocyanate group is too small, the molecular weight of the resultant urea-modified polyester (which is crosslinked and/or whose polymer chain is grown) decreases, thereby deteriorating the hot offset resistance of the resultant toner.

The urea-modified polyester resin for use as a binder resin of the toner of the present invention can be prepared by reacting a polyester prepolymer (A) having an isocyanate group with an amine (B).

Specific examples of such an amine (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine, etc. Specific examples of the amino alcohols (B3) include ethanol amine, hydroxyethyl aniline, etc. Specific examples of the amino mercaptan (B4) include aminoethyl mercaptan, aminopropyl mercaptan, etc. Specific examples of the amino acids (B5) include aminopropionic acid, aminocaproic acid, etc. Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, etc. Among these amines, diamines (B1) and mixtures of a diamine (B1) with a small amount of polyamine (B2) are preferably used.

The molecular weight of the urea-modified polyesters can be controlled using a polymer chain growth inhibitor. Specific examples of the polymer chain growth inhibitor include monoamines (e.g., diethyl amine, dibutyl amine, butyl amine and lauryl amine), and blocked amines (i.e., ketimine compounds) prepared by blocking the monoamines mentioned above.

The ratio of a polyester prepolymer (A) to an amine (B) (i.e., the equivalence ratio [NCO]/[NHx]) of the [NCO] group of a polyester prepolymer (A) having an isocyanate group to the [NHx] group of an amine (B)) is from 1/2 to 2/1, preferably from 1/1.5 to 1.5/1 and more preferably from 1/1.2 to 1.2/1. When the ratio is too low or too high, the molecular weight of the resultant urea-modified polyester decreases, resulting in deterioration of the hot offset resistance of the resultant toner.

The toner of the present invention preferably includes a urea-modified polyester resin (UMPE) as a binder resin. In this regard, the urea-modified polyester resin can include a urethane bond as well as a urea bond. The molar ratio of the urea bond to the urethane bond is from 100/0 to 10/90, preferably from 80/20 to 20/80, and more preferably from 60/40 to 30/70. When the molar ratio of the urea bond is too low, the hot offset resistance of the resultant toner deteriorates.

The modified polyesters such as UMPE can be prepared, for example, by a method such as one-shot methods or prepolymer methods. The weight average molecular weight of the modified polyesters is generally not less than 10,000, preferably from 20,000 to 10,000,000 and more preferably from 30,000 to 1,000,000. When the weight average molecular weight is too low, the hot offset resistance of the resultant toner deteriorates.

The number average molecular weight of the modified polyester resin (such as UMPE) is not particularly limited if an unmodified polyester resin (PE) is used in combination therewith. Specifically, the weight average molecular weight of the modified polyester resin is mainly controlled rather than the number average molecular weight. When the modified polyester resin is used alone, the number average molecular weight of the resin is preferably not greater than 20,000, preferably from 1,000 to 10,000, and more preferably from 2,000 to 8,000. When the number average molecular weight is too high, the low temperature fixability of the resultant toner deteriorates. In addition, when the toner is used as a color toner for use in full color image forming apparatus, the resultant toner images have low glossiness.

It is preferable for the toner of the present invention to include a combination of a modified polyester resin (such as UMPE) with an unmodified polyester resin (PE) as the first binder resin of the toner. By using such a combination, the low temperature fixability of the toner can be improved and in addition the toner can produce color images with high glossiness.

Suitable materials for use as the unmodified polyester resin (PE), which is preferably used as the first binder resin, include polycondensation products of a polyol (PO) with a polycarboxylic acid (PC). Specific examples of the polyol (PO) and polycarboxylic acid (PC) are mentioned above for use in the modified polyester resin. In addition, specific examples of the suitable polyol and polycarboxylic acid are also mentioned above. The weight average molecular weight (Mw) of the unmodified polyester resin (PE) is from 1,000 to 300,000, and preferably from 14,000 to 200,000. The number average molecular weight (Mn) thereof is from 1,000 to 10,000 and preferably from 1,500 to 6,000.

In addition, not only unmodified polyester resins (PE) but also polyester resins including a bond (such as urethane bond) other than a urea bond can be used in combination with the modified polyester resin (UMPE). In other words, polyester resins including a bond (such as urethane bond) other than a urea bond are considered to be unmodified polyester resins in this application.

When a combination of a modified polyester resin (e.g., UMPE) with an unmodified polyester resin (PE) is used as the binder resin, it is preferable that the modified polyester resin is at least partially mixed with the unmodified polyester resin to improve the low temperature fixability and hot offset resistance of the toner. Namely, it is preferable that the modified polyester resin has a molecular structure similar to that of the unmodified polyester resin. The mixing ratio (MPE/PE) of a modified polyester resin (MPE) to an unmodified polyester resin (PE) is from 5/95 to 60/40, preferably from 5/95 to 30/70, more preferably from 5/95 to 25/75, and even more preferably from 7/93 to 20/80. When the added amount of the modified polyester resin is too small, the hot offset resistance of the toner deteriorates, and in addition it is difficult to impart a good combination of high temperature preservability and low temperature fixability to the toner.

In order to impart a good combination of high temperature preservability, low temperature fixability and offset resistance to the toner, the tetrahydrofuran(THF)-soluble components of the polyester prepolymer (A) preferably have a weight average molecular weight of from 1,000 to 30,000. When the weight average molecular weight is too low, the high temperature preservability of the toner deteriorates because the content of oligomer components in the toner increases. In contrast, when the weight average molecular weight is too high, modification of the prepolymer cannot be sufficiently performed due to steric hindrance, resulting in deterioration of the offset resistance of the resultant toner.

In order to impart a good combination of low temperature fixability and hot offset resistance to the toner, the polyester prepolymer (A) preferably has a weight average molecular weight of from 3,000 to 30,000. When the weight average molecular weight is too low, it is difficult to control the reaction speed, resulting in deterioration of production stability. In contrast, when the weight average molecular weight is too high, targeted modified polyester resin cannot be obtained, resulting in deterioration of the offset resistance of the resultant toner.

In the present application, the molecular weight and molecular weight distribution of a resin is determined by gel permeation chromatography (GPC). The method is as follows.

1) the column is allowed to settle in a chamber heated to 40° C. so as to be stabilized;
2) tetrahydrofuran (THF) is passed through the column thus heated to 40° C. at a flow rate of 1 ml/min; and
3) then 50 to 200 μl of a tetrahydrofuran(THF) solution of a resin having a solid content of from 0.05 to 0.6% by weight is injected to the column to obtain a molecular distribution curve of the resin.

The molecular weight distribution of the resin is determined using a working curve which represents the relationship between weight and GPC counts and which is previously prepared using monodisperse polystyrenes. Specific examples of the molecular weights of the monodisperse polystyrenes include $6\times10^2$, $2.1\times10^3$, $4\times10^3$, $1.75\times10^4$, $1.1\times10^5$, $3.9\times10^5$, $8.6\times10^5$, $2\times10^6$, and $4.48\times10^6$. The monodisperse polystyrenes are available from Pressure Chemical Co., or Tosoh Corp. It is preferable to prepare a working curve using ten or more kinds of monodisperse polystyrenes. In measurements, it is preferable to use a RI (refractive index) detector as the detector.

The unmodified polyester resin (PE) used as a first binder resin preferably has an acid value of from 1.0 to 50.0 mgKOH/g. In this case, by adding a basic compound (such as tertiary amines) thereto, a good combination of low temperature fixability, hot offset resistance, high temperature preservability, and charge stability can be imparted to the toner. When the acid value is too high, the polymer chain growth reaction and/or crosslinking reaction of the binder resin precursor becomes insufficient, resulting in deterioration of hot offset resistance. When the acid value is too low, the dispersion stability effect is hardly produced by the basic compound added, and in addition the polymer chain growth reaction and/or crosslinking reaction tend to excessively proceed, and therefore it is difficult to control the molecular weight of the modified polyester resin.

The unmodified polyester resin (PE) preferably has a hydroxyl value not less than 5 mgKOH/g. In addition, the unmodified polyester resin preferably has an acid value of from 1 to 30 mgKOH/g, and more preferably from 5 to 20 mgKOH/g. When an unmodified polyester resin having such an acid value is used as a binder resin, the resultant toner has a negative chargeability, and the affinity of the toner for receiving papers in the fixing process can be improved, resulting in improvement of low temperature fixability of the toner. However, when the acid value is too large, the charge stability of the toner deteriorates particularly when environmental conditions vary. In addition, when the acid value varies in the polymerization process of preparing the unmodified polyester resin, it is difficult to control the emulsification process (i.e., the toner granulation process varies), resulting in variation in particle diameter and particle forms of the resultant toner particles.

In the present application, the acid value and hydroxyl value of a resin are determined by the following methods.

Acid Value

The acid value of a resin is determined by the method described in JIS K0070-1992.

At first, about 0.5 g of a sample (resin), which is precisely measured, is mixed with 120 ml of tetrahydrofuran (THF). After the mixture is agitated for about 10 hours at room temperature (23° C.), 30 ml of ethanol is added thereto to prepare a sample solution. The sample solution is subjected to titration using a N/10 alcohol solution of potassium hydroxide. The acid value (AV) of the sample is determined by the following equation.

$$AV=(\mathrm{KOH}\times N\times 56.1)/W$$

wherein KOH represents the amount (ml) of KOH consumed in the titration, N represents the factor of N/10 potassium hydroxide, and W represents the precise weight of the sample.

The instrument and measurement conditions are as follows.

Instrument: Automatic potentiometric titrator DL-53 (from Mettler Toledo K.K.)
Electrode: DG-113-SC (from Mettler Toledo K.K.)
Analysis software: LabX Light Version 1.00.000
Calibration: A mixture solvent of 120 ml of toluene and 30 ml of ethanol is used.
Measurement temperature: 23° C.
Conditions of the instrument
Stir
  Speed: 25%
  Time: 15 sec
EQP Titration
  Titrant/Sensor
  Titrant: $CH_3ONa$
  Concentration: 0.1 mol/L
  Sensor: DG115
  Unit of measurement: mV
  Predispensing to volume
  Volume: 1.0 mL
  Wait time: 0 sec
  Titrant addition Dynamic
  dE (set): 8.0 mV
  dV (min): 0.03 mL
  dV (max): 0.5 mL
  Measure mode Equilibrium controlled
  dE: 0.5 mV
  dt: 1.0 sec
  t(min): 2.0 sec
  t(max): 20.0 sec
  Recognition
  Threshold: 100.0
  Steepest jump only: No
  Range: No
  Tendency: None
  Termination
  At maximum volume: 10.0 ml
  At potential: No
  At slope: No
  After number EQPS: Yes
    n=1
  Comb. Termination conditions: No
  Evaluation
  Procedure: Standard
  Potential 1: No
  Potential 2: No
  Stop for reevaluation: No Hydroxyl Value The instrument and the measurement conditions are the same as those in the above-mentioned acid value measurement method. The procedure is as follows.

At first, about 0.5 g of a sample, which is precisely measured, is mixed with 5 ml of an acetylizing agent. Then the mixture is heated in a temperature range of 100±0.5° C. using a bath. After one or two hours, the flask is drawn from the bath. After cooling the flask, water is added thereto and the mixture is shaken to decompose acetic anhydride. Further, in order to completely decompose acetic anhydride, the flask is heated for 10 minutes or more using the bath. After cooling the flask, the inner surface of the flask is well washed with an organic solvent. This liquid is subjected to a potentiometric titration treatment using a N/2 ethyl alcohol solution of potassium hydroxide to determine the hydroxyl value of the sample. The measurement method is based on JIS K0070-1966.

The high temperature preservability of the toner depends on the heat resistance of the modified polyester resin used as a binder resin, which depends on the glass transition temperature of the polyester resin before modification. The polyester resin before modification preferably has a glass transition temperature of from 35 to 65° C. When the glass transition temperature is too low, the high temperature preservability of the toner deteriorates. In contrast, when the glass transition temperature is too high, the low temperature fixability of the toner deteriorates.

Measurements of the glass transition temperature of a resin are performed using an instrument TG-DSC system TAS-100 manufactured by RIGAKU CORPORATION. The procedure for measurements of glass transition temperature is as follows:

1) about 10 mg of a sample is contained in an aluminum container, and the container is set on a holder unit;
2) the holder unit is set in an electrical furnace, and the sample is heated from room temperature to 150° C. at a temperature rising speed of 10° C./min;
3) after the sample is allowed to settle for 10 minutes at 150° C., the sample is cooled to room temperature; and
4) after the sample is allowed to settle for 10 minutes at room temperature, the sample is heated again from room temperature to 150° C. in a nitrogen atmosphere at a temperature rising speed of 10° C./min to perform a DSC measurement.

The glass transition temperature of the sample is determined using an analysis system of the TAS-100 system. Namely, the glass transition temperature is defined as the contact point between the tangent line of the endothermic curve observed at a temperature near the glass transition temperature and the base line of the DSC curve.

(Release Agent)

The toner of the present invention can include a release agent. Suitable release agents include waxes having a melting point of from 50 to 120° C. In this regard, the melting point is defined as the temperature at which the maximum endothermic peak is observed in differential scanning calorimetry (DSC). When such a wax is included in the toner, the wax is dispersed in the binder resin and serves as a release agent while being present at a location between a fixing roller and the toner particles in the fixing process. Thereby, the hot offset problem can be avoided without applying an oil to the fixing roller used.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. Further, fatty acid amides such as 12-hydroxylstearic acid amide, stearic acid amide and phthalic anhydride imide; and low molecular weight crystalline polymers such as acrylic homopolymers and copolymers having a long alkyl group in their side chains, e.g., poly-n-stearyl methacrylate, poly-n-laurylmethacrylate and n-stearyl acrylate-ethyl methacrylate copolymers, can also be used as release agents.

(Colorant)

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner of the present invention.

Specific examples of the resins for use as the binder resin of the master batches include polyesters (such as the modified and unmodified polyester resins mentioned above), polymers of styrene or styrene derivatives such as polystyrene, poly-p-chlorostyrene, and polyvinyl toluene; copolymers of styrene with a vinyl monomer such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleate copolymers; and other resins such as polymethyl methacrylate, polybutyl methacrylate, polyvinyl chloride, polyvinyl acetate, polyethylene, polypropylene, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, and paraffin waxes. These materials can be used alone or in combination.

Such master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

(Charge Controlling Agent)

The toner of the present invention optionally includes a charge controlling agent. Known charge controlling agents for use in conventional toners can be used for the toner of the present invention.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

In order to securely fix a charge controlling agent to the surface of toner particles, the toner of the present invention is preferably prepared by a known method in which particles of a charge controlling agent are mixed with toner particles including at least a colorant and a binder resin in a container using a rotor. When preparing the toner of the present invention, it is more preferable to use a container having no projection on the inner surface thereof while rotating the rotor at a peripheral speed of from 40 to 150 m/sec.

The added amount of the charge controlling agent in the toner of the present invention is not particularly limited, and is determined depending on variables in preparing the toner, such as choice of binder resin, presence or absence of optional additives, and the dispersing method used. However, the added amount of the charge controlling agent is preferably from 0.1 to 10 parts by weight, and more preferably from 0.2 to 5 parts by weight, per 100 parts by weight of the binder resin including in the toner. When the added amount is too large, the toner is excessively charged. Thereby, the effect of the main charge controlling agent is deteriorated, and the electrostatic attraction between the toner and the developing roller seriously increases, resulting in deterioration of the fluidity of the toner, and formation of images with low image density.

The charge controlling agent and release agent can be included in the toner by being mixed with the master batch or the binder resin upon application of heat thereto. Alternatively, the agents can be added when toner components such as binder resins and colorants are dissolved or dispersed in an organic solvent.

The toner of the present invention is typically prepared by the following method, but the preparation method is not limited thereto.

(Preparation of Binder Resin)

The modified polyester resins (such as UMPE) for use as the binder resin are typically prepared by the following method, but the preparation method is not limited thereto.

At first, a polyol (PO) and a polycarboxylic acid (PC) are heated to a temperature ranging from 150 to 280° C. in the presence of an esterification catalyst such as tetrabutoxy titanate and dibutyl tin oxide to be reacted. In this case, generated water is removed under a reduced pressure, if necessary. Thus, a polyester resin having a hydroxyl group is prepared. The thus prepared polyester resin is reacted with a polyisocyanate (PIC) at a temperature ranging from 40 to 140° C. to prepare a polyester prepolymer (A) having an isocyanate group. The prepolymer (A) is reacted with an amine (B) at temperature ranging from 0 to 140° C. to prepare a urea-modified polyester resin (UMPE). The modified polyester resin preferably has a number average molecular weight of from 1,000 to 10,000 and more preferably from 1,500 to 6,000. When a polyisocyanate (PIC) is reacted with a polyester, and a polyester prepolymer (A) is reacted with an amine (B), one or more solvents may be used, if desired. Specific examples of the solvents include solvents inactive with polyisocyanates (PIC), such as aromatic solvents (e.g., toluene and xylene); ketones (e.g., acetone, methyl ethyl ketone and methyl isobutyl ketone); esters (e.g., ethyl acetate); amides (e.g., dimethylformamide and dimethylacetamide); and ethers (e.g., tetrahydrofuran).

The unmodified polyester resin (PE) for use in the toner of the present invention, which does not have a urea bond, is prepared by a method similar to the method mentioned above for use in preparing the polyester resin having a hydroxyl group. The thus prepared unmodified polyester resin (PE) is mixed with a solution of the modified polyester resin (UMPE).

(Preparation of Toner in Aqueous Medium)

A toner component liquid, which is prepared by dissolving or dispersing toner components such as binder resins (including a polyester prepolymer), modified layered inorganic materials, colorants and additives in a solvent, is dispersed in an aqueous medium to prepare an emulsion. Suitable materials for use as the aqueous medium include water. In addition, organic solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

In the aqueous medium, a reactive modified polyester resin (such as polyester prepolymers (A) having an isocyanate group) is reacted with an amine (B) to produce a urea-modified polyester resin (UMPE). In order to stably disperse a toner component liquid including such a polyester prepolymer (A) (and a urea-modified polyester resin (UMPE) delivered from the polyester prepolymer) in an aqueous medium, it is preferable to apply a shearing force to the mixture. The reactive modified polyester can be mixed with other toner components such as colorants, colorant master batches, release agents, charge controlling agents, and unmodified polyester resins when the materials are dispersed in an aqueous medium to prepare a toner component liquid. However, it is preferable that the reactive modified polyester and the other toner components are previously mixed, the mixture is dissolved or dispersed in a solvent to prepare a toner component liquid, and then the toner component liquid is dispersed in an aqueous medium. In addition, some of the toner components such as colorants, release agents and charge controlling agents are not necessarily mixed with other toner constituents when particles are formed in an aqueous medium, and can be mixed with the resultant toner particles formed in the aqueous medium. For example, a method in which after particles including no colorant are formed in an aqueous medium, the particles are dyed with a colorant using a known dyeing method can also be used.

Known dispersing machines can be used for emulsifying the toner component liquid in an aqueous medium. Suitable dispersing machines include low speed shearing dispersion machines, high speed shearing dispersion machines, friction dispersion machines, high pressure jet dispersion machines, ultrasonic dispersion machines, etc. In order to prepare a dispersion having a particle diameter of from 2 to 20 μm, high speed shearing dispersion machines are preferably used.

When high speed shearing dispersion machines are used, the revolution of the rotor is not particularly limited, but the revolution is generally from 1,000 to 30,000 rpm, and preferably from 5,000 to 20,000 rpm. The dispersion time is not particularly limited. When a batch dispersion machine is used, the dispersion time is generally from 0.1 to 5 minutes. The dispersion temperature is preferably from 0 to 150° C. (under pressure, if necessary) and preferably from 40 to 98° C. It is preferable that dispersing is performed at a relatively high temperature because the dispersion has a low viscosity and thereby dispersing can be easily performed.

The weight ratio of the aqueous medium to the toner component liquid including a polyester resin (such as prepolymers (A) (and UMPE) and unmodified polyester resins (PE)) and a modified layered inorganic material is generally from 50/100 to 2,000/100 and preferably from 100/100 to 1,000/100. When the added amount of the aqueous medium is too small, the toner component liquid cannot be well dispersed, and thereby toner particles having a desired particle diameter cannot be easily prepared. Adding a large amount of aqueous medium is not economical.

When the toner component liquid is emulsified and dispersed in an aqueous medium, a dispersant such as surfactants, particulate inorganic dispersants, particulate polymer dispersants is preferably included in the aqueous medium to prepare toner particles having a sharp particle diameter distribution.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkyl(C7-C13) carboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants having a fluoroalkyl group, which can disperse a toner component liquid in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SARFRON S-121 (from Asahi Glass Co., Ltd.); FLUORAD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Inorganic dispersants hardly soluble in water, such as tricalcium phosphate, calcium carbonate, titanium oxide, colloidal silica and hydroxyapatite can also be used.

Particulate polymers have the same effect as the particulate inorganic dispersants. Specific examples of the particulate polymers include particulate polymethyl methacrylate having a particle diameter of 1 μm or 3 μm, particulate polystyrene having a particle diameter of 0.5 μm or 2 μm, particulate styrene-acrylonitrile copolymers having a particle diameter of 1 μm (e.g., PB-200H from Kao Corp., SPG from Soken Chemical & Engineering Co., Ltd., TECHNOPOLYMER SB from Sekisui Plastic Co., Ltd., SGP-3G from Soken Chemical & Engineering Co., Ltd., and MICROPEARL from Sekisui Fine Chemical Co., Ltd.)

Further, it is preferable to stabilize the emulsion or dispersion using a polymer protection colloid in combination with the inorganic dispersants and particulate polymers.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The thus prepared emulsion (i.e., reaction product) is agitated at a temperature lower than the glass transition temperature of the binder resin without evaporating the organic solvent to prepare aggregated particles. Then the emulsion is heated to remove the organic solvent from the emulsion while agitating the emulsion such that the emulsion has laminar flow, resulting in formation of deformed toner particles. When a dispersant such as calcium phosphate, which can be dissolved in an acid or an alkali, is used, it is preferable to dissolve the dispersant with hydrochloric acid to remove that from the toner particles, followed by washing. In addition, it is possible to remove such a dispersant by decomposing the dispersant using an enzyme. However, toner particles, on the surface of which the dispersant used remains, can also be used for the toner of the present invention.

In order to reduce the viscosity of the toner component liquid, solvents capable of dissolving polyesters such as urea-modified polyester resins and polyester prepolymers can be used. In this case, the resultant toner particles have a sharp particle diameter distribution. Suitable solvents include volatile solvents having a boiling point lower than 100° C. so as to be easily removed from the resultant toner particles. Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used. The weight ratio of the solvent to the polyester prepolymer is generally from 0/100 to 300/100, preferably from 0/100 to 100/100 and more preferably from 25/100 to 70/100. When a solvent is used, the solvent is removed from the reaction product under normal or reduced pressure after the polymer chain growth reaction and/or the crosslinking reaction of a modified polyester (i.e., a polyester prepolymer) with an amine.

The reaction time is determined depending on the reactivity of the isocyanate group of the polyester prepolymer with the amine used, and is generally from 10 minutes to 40 hours, and preferably from 2 to 24 hours. The reaction temperature is generally from 0 to 150° C., and preferably from 40 to 98° C.

In addition, known catalysts such as dibutyltin laurate and dioctyltin laurate can be used for the reaction, if desired. As mentioned above, amines (B) are typically used as the polymer chain growing agent and/or the crosslinking agent.

When preparing toner particles of the toner of the present invention, it is preferable that the reaction product, which has been subjected to a polymer chain growth reaction and/or a crosslinking reaction, is agitated at a temperature lower than the glass transition temperature of the binder resin included in the particles without evaporating the solvent included in the particles to prepare aggregated particles. After the shape and size of the resultant particles are confirmed, the solvent is removed from the reaction product at a temperature of from 10 to 50° C. By performing agitation before the solvent removal operation, the particles are deformed. The conditions such as temperature, agitation speed and agitation time should be properly determined such that the resultant toner particles have the desired shape and size. For example, when the concentration of the organic solvent in the oil phase liquid in the reaction product is high and thereby the oil phase liquid has a low viscosity, the resultant aggregated particles tend to have a spherical form. In contrast, when the concentration of the organic solvent in the oil phase liquid in the reaction product is low, particles cannot be well aggregated because the oil phase liquid has a high viscosity. Therefore, proper conditions should be set when preparing toner particles. In other words, it is possible to adjust the shape of the toner particles by adjusting the conditions.

Further, the shape of the toner particles can be adjusted by adjusting the concentration of the modified layered inorganic material in the toner component liquid. The content of a modified layered inorganic material in the toner component liquid is preferably from 0.05 to 10% by weight based on the solid components included in the toner component liquid. When the concentration is too low, the oil phase liquid (i.e., the toner component liquid) does not have a desired viscosity, and therefore the aggregated particles cannot have the targeted shape. Specifically, the oil phase liquid has a low viscosity, and therefore the aggregated particles tend to have a spherical form. In contrast, when the concentration is too high, the productivity of the toner particles deteriorates. In addition, when the oil phase liquid has too high viscosity, the particles of the oil phase liquid in the aqueous phase liquid cannot be well aggregated. In this case, the resultant toner has poor fixing property.

Next, the properties of the toner of the present invention and methods for measuring the properties will be explained.

(Average Circularity)

The toner of the present invention preferably has an average circularity of from 0.925 to 0.970, and more preferably from 0.945 to 0.965. The circularity of a particle is determined by the following equation:

$$\text{Circularity}=L2/L1,$$

wherein L1 represents the length of the circumference of the projected image of a particle and L2 represents the length of the circumference of a circle having the same area as that of the projected image of the particle. The average circularity can be determined by averaging the circularities of a number of toner particles.

In addition, the content of toner particles having a circularity of less than 0.925 in the toner is preferably not greater than 15% by number.

When the average circularity is too small, the transferability of the toner deteriorates and thereby high quality images with little toner scattering cannot be produced. In contrast, when the average circularity is too large, toner particles remaining on an image bearing member and an intermediate transfer medium cannot be well removed with a cleaning blade, and thereby images with background fouling are produced. In addition, when pictorial images are formed or a toner image remains on an image bearing member due to jamming of a receiving material sheet, residual toner particles tend to accumulate on the surface of the image bearing member, and thereby a charging roller for charging the image bearing member is contaminated with the residual toner particles, resulting in deterioration of the chargeability of the charging roller. Further, as mentioned below, toner having a small particle diameter and a sharp particle diameter distribution tends to cause a cleaning problem. Therefore, the toner of the present invention preferably includes toner particles having a circularity of not greater than 0.950 in an amount of from 20 to 80% by number.

In the present application, the average circularity of the toner is determined by the following method using a flow-type particle image analyzer FPIA-2100 from Sysmex Corp. The procedure is as follows.

(1) 0.5 ml of a 10% surfactant (alkylbenzenesulfonate, NEOGEN SC-A from Dai-ichi Kogyo Seiyaku Co., Ltd.) is fed into a 100-ml glass beaker;
(2) 0.1 to 0.5 g of a sample (i.e., a toner) is fed to the beaker, and the mixture is agitated by a micro spatula;
(3) 80 ml of ion-exchange water is fed to the beaker;
(4) the mixture is dispersed for 3 minutes by a supersonic dispersing machine (W-113MK-II from Honda Electronics Co., Ltd.) to prepare a toner dispersion; and
(5) the average circularity of the sample in the suspension is determined by the measuring instrument mentioned above, wherein the concentration of the dispersion is controlled such that the dispersion includes particles of 5,000 to 15,000 per 1 micro-liter.

(Volume Average Particle Diameter (Dv) and Number Average Particle Diameter (Dn))

The toner of the present invention preferably has a ratio (Dv/Dn) of the volume average particle diameter (Dv) to the number average particle diameter (Dn) of from 1.00 to 1.30, and more preferably from 1.00 to 1.20. In this case, the toner can produce high quality and high definition images. In addition, variation of the particle diameter distribution of the toner is little and the toner can maintain good developability even when the toner is agitated over a long period of time in a developing device while a fresh toner is supplied thereto. When the ratio (Dv/Dn) is too large, variation of the particle diameter distribution of the toner becomes large, resulting in variation of the behavior of the toner, thereby deteriorating fine dot reproducibility of toner images.

The ratio (Dv/Dn) of the volume average particle diameter (Dv) of the toner to the number average particle diameter (Dn) thereof can be controlled by controlling factors such as viscosities of the aqueous phase liquid and oil phase liquid, and properties and added amount of the particulate resin included in the aqueous phase. In addition, the volume average particle diameter and the number average particle diameter of the toner can be controlled by controlling factors such as properties and added amount of the particulate resin included in the aqueous phase.

The toner of the present invention preferably has a volume average particle diameter (Dv) of from 3.0 to 7.0 μm.

In general, using a toner having a small average particle diameter is advantageous to produce high definition and high quality images. However, such a toner is inferior in transferability and cleanability. When a toner having a volume average particle diameter smaller than the above-mentioned range is used for a two component developer, the toner tends to cause a problem in that the toner is fixedly adhered to a carrier after long term agitation, resulting in deterioration of the chargeability of the carrier. When such a small-size toner is used as a one component developer, problems in that the toner forms a film on a developing roller, and the toner is fixedly adhered to a member (such as blades) configured to form a thin toner layer tend to be caused. In addition, these phenomena are largely influenced by the content of fine toner particles. Specifically, when toner particles having a particle diameter of not greater than 2 μm are included in an amount of greater than 20% by number, the toner adhesion problem is seriously caused and in addition the charge stability of the toner seriously deteriorates. Therefore, the content of toner particles having a particle diameter of not greater than 2 μm in the toner is preferably not greater than 20% by number.

In contrast, when the volume average particle diameter of the toner is larger than the above-mentioned range, it is difficult to produce high definition and high quality images and in addition a problem in that the particle diameter distribution of the toner in a developer largely changes when the toner is used while replenishing a fresh toner to the developer, resulting in variation of image qualities tends to occur. The same is true for the case where the ratio (Dv/Dn) is too large.

Next, the relationship between the shape of toner and cleanability of the toner will be explained.

Before explaining the relationship between the shape of toner and cleanability thereof, the relationship between the shape of toner and transferability of the toner will be explained.

In full color copiers, the amount of toner particles present on an image bearing member is larger than that in black and white copiers. Therefore, it is difficult to improve the transfer efficiency by using conventional toner having irregular forms. Further, when a conventional toner having irregular forms is used, the toner tends to be fixed to the surfaces of the photoreceptor and intermediate transfer medium used (and a toner film is formed on the surfaces thereof) due to friction therebetween, resulting in deterioration of transferability of toner images. Particularly, in full color image forming apparatus, four color toner images cannot be evenly transferred to an intermediate transfer medium, thereby producing full color images with poor evenness and color balance. Therefore, high quality full color images cannot be produced.

In addition, toner having a spherical form or a form near the spherical form cannot be well removed from the surface of an image bearing member with a cleaning blade.

In order to impart a good combination of transferability and cleanability to a toner, the percentage of toner particles having a circularity of not greater than 0.950 in the toner is preferably from 20% to 80% by number. The cleanability of the toner varies depending on the material of the blade and the angle of the blade set on the image bearing member, and the transferability of the toner varies depending on the transfer conditions. Therefore, it is preferable to determine the proper percentage of toner particles having a circularity of not greater than 0.950 depending on the cleaning conditions and transfer conditions.

However, when the content of toner particles with a circularity of not greater than 0.950 is too low, the blade cleanability deteriorates. In contrast, when the content of such toner particles is too high, the transfer efficiency deteriorates. The reason therefrom is as follows. In this case, almost all the toner particles have irregular forms, the toner particles are not smoothly transferred (from the surface of an image bearing member to the surface of an intermediate transfer medium or a receiving material, from the surface of an intermediate transfer medium to a receiving material, etc.) and in addition the behavior of the toner particles varies. Therefore, it is difficult to evenly transfer toner images with high efficiency. In addition, the toner has unstable charging property and the particles of the toner tend to be easily cracked, resulting in formation of fine toner particles when the toner is agitated together with a carrier in a developing device. Thus, the toner has poor durability.

The percentage of toner particles having a circularity of not greater than 0.950 in the toner is determined by the method mentioned above for use in determining the average circularity.

(Method for Determining Particle Diameter)

The particle diameter and particle diameter distribution of a toner are measured with a method using an instrument such as COULTER COUNTER TA-II and COULTER MULTISIZER II from Beckman Coulter Inc. In the present application, a system including COULTER COUNTER TA-II, an interface capable of outputting particle diameter distribution on number and volume basis (from Nikka Giken), and a personal computer PC9801 (from NEC) is used to determine the particle diameter and particle diameter distribution. Specifically, the procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl or ISOTON-II manufactured by Beckman Coulter Inc.;
(2) 2 to 20 mg of a sample to be measured is added into the mixture;
(3) the mixture is subjected to an ultrasonic dispersion treatment for about 1 to 3 minutes; and
(4) the volume-basis particle diameter distribution and number-basis particle diameter distribution of the sample are determined using the instrument and an aperture of 100 μm.

In the present invention, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 μm to 40.30 μm are targeted. The volume average particle diameter (Dv) and number average particle diameter (Dn) are determined from the volume-basis particle diameter distribution and the number-basis particle diameter distribution. In addition, the ratio (Dv/Dn) can be determined by calculation.

(Glass Transition Temperature)

The toner of the present invention preferably has a glass transition temperature of from 40 to 70° C. In this case, the toner has a good combination of low temperature fixability, high temperature preservability and durability. When the glass transition temperature is too low, the toner tends to cause a blocking problem in that the toner particles are adhered to each other, resulting in formation of toner blocks or occurrence of a filming problem in that the toner is adhered to the surface of the image bearing member, resulting in formation of a film of the toner thereon, thereby deteriorating the image qualities. In contrast, when the glass transition temperature is too high, the low temperature fixability of the toner deteriorates.

The method for determining the glass transition temperature of the toner is the same as the method mentioned above for use in determining the glass transition temperature of a binder resin.

(Acid Value)

The present inventors discover that the acid value of the toner is a more important index to low temperature fixability and hot offset resistance than the acid value of the binder resin of the toner. The acid value of the toner of the present invention is imparted by the carboxyl groups present at the ends of the unmodified polyester resin (PE) included in the toner as a binder resin. In order to impart a good combination of low temperature fixability (e.g., lowest fixable temperature) and hot offset temperature to the toner, it is preferable to control the acid value of the toner in a range of from 0.5 to 40.0 mgKOH/g. When the acid value of the toner is too high, the polymer chain growth reaction and/or crosslinking reaction of the modified polyester (i.e., polyester prepolymer) cannot be sufficiently performed, resulting in deterioration of the hot offset resistance of the toner. In contrast, when the acid value of the toner is too low, the dispersion (i.e., the oil phase liquid dispersed in an aqueous medium) cannot be stabilized by a basic compound in the preparation process of the toner, thereby causing a manufacturing problem in that the polymer chain growth reaction and/or crosslinking reaction of the modified polyester excessively proceed.

The method for determining the acid value of the toner is the same as the method mentioned above for use in determining the acid value of a binder resin. When the toner includes tetrahydrofuran(THF)-insoluble components, the acid value of the toner is defined as the acid value of the THF-soluble components of the toner. When THF is used as a solvent, the amount of the sample (i.e., toner) is 0.5 g. When ethyl acetate is used, the amount of the sample (i.e., toner) is 0.3 g.

(External Additive)

The thus prepared toner particles are mixed with an external additive to impart a good combination of fluidity, developing property and chargeability to the resultant toner.

Specific examples of the materials for use as the external additive include known materials for use as external additives of toner such as silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc., but are not limited thereto. These materials can be subjected to a hydrophobizing treatment.

The toner of the present invention preferably includes at least three kinds of external additives, and more preferably a first hydrophobic silica having a BET specific surface area of from 20 to 40 $m^2/g$, a hydrophobic titanium oxide having a BET specific surface area of from 40 to 80 $m^2/g$, and a second hydrophobic silica having a BET specific surface area of from 130 to 300 $m^2/g$. The toner can further includes another external additive to impart another function to the toner.

It is more preferable that the first hydrophobic silica has a BET specific surface area of from 25 to 35 $m^2/g$, the hydrophobic titanium oxide has a BET specific surface area of from 50 to 75 $m^2/g$, and the second hydrophobic silica preferably has a BET specific surface area of from 140 to 250 $m^2/g$.

The content of each of the external additives in the toner is preferably from 0.01 to 5.0% by weight, and more preferably from 0.01 to 2.0% by weight, based on the weight of the toner.

The external additive is preferably subjected to a hydrophobizing treatment to improve the hydrophobicity thereof, resulting in improvement of the fluidity and chargeability of the toner even under high humidity conditions. Specific examples of the hydrophobizing agents include silane coupling agents, silylating agents, silane coupling agents having a fluorinated alkyl group, organic titanate coupling agents, aluminum coupling agents, silicone oils, modified silicone oils, etc. Particularly, silica and titanium oxide, which are subjected to a hydrophobizing treatment using such a hydrophobizing agent, are preferably used for the toner of the present invention.

The hydrophobicity of each of the external additives is preferably from 50 to 90%, which is determined by a wettability measuring method using methanol, i.e., a powder wettability tester WET-100P from RHESCA COMPANY LTD. Specifically, the procedure is as follows:

(1) 50 ml of pure water is fed into a 200 ml beaker;
(2) then 0.2 g of a sample (i.e., an external additive) is fed into the beaker (in this case, the sample is floating on pure water);
(3) methanol is dropped thereinto at a speed of 1 ml/min while gently agitating the mixture using a magnetic stirring bar; and
(4) the concentration (percentage) of methanol in the mixture of water and methanol is defined as the hydrophobicity at a time when all the particles of the sample (i.e., an external additive) floating on the surface of the mixture of water and methanol sink into the mixture.

Namely, hydrophobicity (H) is determined by the following equation:

$$H(\%)=\{M/(50+M)\}X\,100$$

wherein M represents the volume (ml) of methanol added.

In this regard, as the value H increases, the sample has higher hydrophobicity, i.e., the sample is more highly hydrophobic.

When the added amount of methanol is too large for a 200 ml beaker, a 300 ml beaker or a larger beaker is used.

In the above-mentioned method, methanol serves as a surfactant. As methanol is added to water, the particles of the sample (external additive) floating on water (or a mixture of water and methanol) are dispersed in the mixture. The When three kinds of external additives are mixed with toner particles, it is preferable that at first a first hydrophobic silica having a BET specific surface area of from 20 to 40 $m^2/g$ is mixed with the toner particles to be adhered to the surface of the toner, and then a hydrophobic titanium oxide having a BET specific surface area of from 40 to 80 $m^2/g$ is mixed therewith to be adhered thereto. Finally, a second hydrophobic silica having a BET specific surface area of from 130 to 300 $m^2/g$ is mixed therewith. Next, the mixture is sieved using a 400-mesh screen to remove coarse particles and aggregated particles therefrom. Thus, the toner of the present invention is prepared.

By adhering the first hydrophobic silica to the surface of the toner particles at first, the first hydrophobic silica is strongly adhered to the surface of the toner particles, and thereby the first hydrophobic silica is hardly released from the surface of the toner particles. Therefore, even when high-frequency AC charging is performed (i.e., even when charging hazard is large), high quality images can be produced without causing the filming problem.

In addition, by adhering the hydrophobic titanium oxide to the surface of the toner particles before adhering the second hydrophobic silica to the toner particles, releasing of the titanium oxide from the toner particles is prevented, resulting in prevention of deterioration of chargeability of the carrier and prevention of occurrence of toner scattering. Therefore, high quality images can be produced over a long period of time.

Measurements of the BET specific surface area of a toner are performed using an instrument such as TRISTAR 3000 from Shimadzu Corp. Specifically, at first the relationship between pressures of nitrogen and amounts of nitrogen adsorbed on an external additive is obtained. The BET specific surface area (per 1 gram) of the external additive is determined by calculation on the basis of the relationship and the BET theory. It is preferable to perform vacuum deaeration on the sample for 24 hours using a deaeration unit VACUPREP 061 (from Shimadzu Corp.) before measuring the BET specific surface area of the sample, to remove foreign materials (particularly, moisture) present on the surface of the sample.

(Lubricant)

A lubricant is included in the toner of the present invention or is applied to the surface of the image bearing member and/or an intermediate transfer medium to easily remove residual toner particles from the image bearing member and/or an intermediate transfer medium. Specific examples of the materials for use as the lubricant include fatty acids and fatty acid metal salts such as stearic acid, zinc stearate, and calcium stearate; particulate polymers such as polymethyl methacrylate, and polystyrene prepared by a soap-free emulsion methods; etc. Among the particulate polymers, particulate polymers having a sharp particle diameter distribution are preferably used, and the volume average particle diameter thereof is preferably from 0.01 to 1 μm. When the lubricant is applied to the image bearing member and/or intermediate transfer medium, a stick of the lubricant, which has a cylindrical or prismatic shape and which is long enough to be applied to the image bearing member for a long period of time, is preferably used.

The toner of the present invention can be used for a two-component developer by being mixed with a magnetic carrier. In this case, the content of the toner is preferably from 1 to 10 parts by weight per 100 parts by weight of a carrier.

Suitable materials for use as the carrier of the two component developer include known carrier materials such as iron powders, ferrite powders, magnetite powders, magnetic resin carriers, which have a particle diameter of from about 20 to about 200 μm. The surface of the carriers may be coated with a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, fluoroterpolymers (such as terpolymers of tetrafluoroethylene, vinylidenefluoride and other monomers including no fluorine atom), silicone resins, etc., can also be used for the resin layer.

If desired, an electroconductive powder may be included in the resin layer covering the carrier. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant carrier.

Next, the image forming method and apparatus of the present invention will be explained.

The image forming apparatus of the present invention performs at least a charging process, a light irradiating process, a developing process, a transfer process, a fixing process, a cleaning process, a lubricant applying process and a lubricant spreading process, and optionally performs a discharging process, a toner recycling process and a controlling process.

Next, the processes and the devices used therefor will be explained in detail.

(Image Bearing Member)

The image bearing member of the image forming apparatus of the present invention is not particularly limited with respect to the constitutional materials, shape, structure, size, etc. For example, with respect to the shape, drum-form, sheet-form, and endless belt-form image bearing members can be used, but drum form photoreceptors are preferably used therefor.

The image bearing member is preferably a photoreceptor such as inorganic photoreceptors including an inorganic photosensitive material such as amorphous silicon and selenium; and organic photoreceptors (OPCs) including an organic photosensitive material such as polysilane and phthalopolymethine. Among these photosensitive materials, amorphous silicon is preferably used because of having a relatively long life.

An electrostatic latent image can be formed on the image bearing member by charging the surface of the image bearing member and then imagewise irradiating the charged surface with light. Therefore, the image forming apparatus includes a charger configured to charge the image bearing member, and a light irradiating device configured to irradiate the charged surface of the image bearing member with light. In the image forming apparatus of the present invention, the linear speed of the image bearing member is preferably not less than 300 mm/sec.

(Charging Process and Charger)

In the charging process, a charger applies a voltage to the surface of the image bearing member. The charger applies a DC voltage, on which an AC voltage with a frequency of from 6.5 to 8.5 cycle/mm is superimposed, without contacting the surface of the image bearing member. The charger is preferably a charging roller. When the AC frequency is from 7.5 to 8.5 cycle/mm, the number of occurrence of electric discharge in a unit time is large. Therefore, the image bearing member faces great electric hazards, thereby easily causing the filming problem. However, in this case, charging is performed uniformly. In contrast, when the AC frequency is from 6.0 to 6.5 cycle/mm, the image qualities deteriorate although the electric hazards are eliminated. Therefore, it is preferable to control the AC frequency in a range of from 6.5 to 8.5 cycle/mm while preventing the image bearing member from facing great electric hazards (i.e., preventing occurrence of the filming problem) as much as possible. As mentioned below, a lubricant is applied to the surface of the image bearing member to prevent occurrence of the filming problem when the AC frequency is in a range of from 7.5 to 8.5 cycle/mm. In this case, the image forming apparatus has a large size because of having a lubricant applicator. In the present invention, occurrence of the filming problem can be prevented by using the toner mentioned above.

(Light Irradiating Process and Light Irradiating Device)

In the light irradiation process, a light irradiating device irradiates the charged image bearing member with imagewise light to form an electrostatic latent image on the image bearing member.

The light irradiating device is not particularly limited, and any known devices can be used therefor. Specific examples thereof include optical systems for use in copiers, rod lens arrays, optical systems using a laser or a liquid crystal shutter, or the like.

Light irradiating methods in which light irradiates an image bearing member from the inside (backside) of the image bearing member can also be used.

(Developing Process and Developing Device)

In the developing process, an electrostatic latent image formed on an image bearing member is developed with a developer including a toner using a developing device to form a toner image (i.e., a visual image) on the image bearing member.

The developing device is not particularly limited, and any known developing devices can be used as long as the devices can develop an electrostatic image with a developer including the toner of the present invention. For example, devices which contain a developer including the toner of the present invention and which applies the toner to an electrostatic image by contacting the toner with the electrostatic image or without contacting the toner therewith. The developing device is a dry developing device, and may be a monochrome developing device capable of forming monochrome toner images or a multi-color developing device capable of forming plural color toner images. Specifically, the developing device includes at least an agitator configured to agitate the developer to charge the toner, and a developing member configured to bear the developer using a rotatable magnet roller to develop an electrostatic image with the developer. The developer is a two-component developer including the toner of the present invention.

In the developing device, the toner of the present invention and a carrier are mixed and agitated to frictionally charge the toner. The developer including the toner is borne on the surface of the developing roller due to the magnetic force of the magnet roller located in the developing roller while forming a magnetic brush. Since the developing roller is set close to the image bearing member (such as photoreceptor drums), part of particles of the toner in the magnetic brush is electrically attracted by an electrostatic latent image on the image bearing member, resulting in transfer of the toner particles to the latent image. Thus, the latent image is developed with the toner, resulting in formation of a toner image (i.e., a visual image) on the surface of the image bearing member.

(Transfer Process and Transferring Device)

In the transfer process, a toner image formed on the image bearing member is transferred onto a receiving material. It is preferable to primarily transfer a toner image on the image bearing member to an intermediate transfer medium, followed by secondarily transferring the toner image onto a receiving material. In this case, it is preferable that plural color toner images such as full color toner images are formed. Specifically, plural color toner images are formed on one or more image bearing members, and the plural color toner images are sequentially transferred onto an intermediate transfer medium, resulting in formation of a combined color toner image on the intermediate transfer medium. The combined color toner image is then transferred onto a receiving material.

The transfer process is typically performed using a transferring device which charges the image bearing member. The transferring device preferably includes a primary transferring member configured to transfer one or more color toner images on the image bearing member or members to the intermediate transfer medium to form a combined color toner image, and a secondary transferring member configured to transfer the combined color toner image on the intermediate transfer medium to a receiving material. Any known intermediate transfer media can be used, and a proper intermediate transfer medium (such as transfer belts) is selected therefrom in consideration of the specification of the intermediate transfer medium of the image forming apparatus of the present invention.

The transferring device preferably includes one or more transfer members configured to charge a toner image so as to be easily transferred to a receiving material. Specific examples of the transfer members include corona discharging members, transfer belts, transfer rollers, pressure rollers, adhesive transfer members, etc.

Any known materials (such as paper sheets) for use as receiving materials for conventional image forming apparatus can be used for the image forming apparatus of the present invention.

(Fixing Process and Fixing Device)

In the fixing process, a toner image transferred on a sheet of a receiving material is fixed thereto by a fixing device. When plural color toner images are sequentially transferred onto a receiving material, the fixing operation may be performed on each of the color toner images or performed on the overlaid plural color toner images (i.e., the combined color toner image) at the same time.

The fixing device is not particularly limited, but heat/pressure fixing devices capable of heating and pressing are preferably used. For example, combinations of a heat roller and a pressure roller and combinations of a heat roller, a pressure roller and an endless belt can be preferably used. The temperature of the heating members (such as heat rollers) is preferably from 80 to 200° C.

A light fixing device configured to fix a toner image using light can be used in combination of or instead of a heat/pressure fixing device depending on the purpose and specification of the image forming apparatus.

(Discharging Process and Discharging Device)

In the discharging process, charges remaining on the image bearing member even after the transfer process are removed by applying a bias or light to the image bearing member using a discharging device. Any known discharging devices such as discharging lamps and chargers can be used.

(Cleaning Process and Cleaning Device)

In the cleaning process, toner particles remaining on the image bearing member are removed therefrom using a cleaning member of a cleaning device. In the image forming apparatus of the present invention, the cleaning device preferably includes a blade as the cleaning member.

(Lubricant Application Process and Lubricant Applicator)

In the lubricant application process, the lubricant mentioned above (such as zinc stearate) is applied to the surface of the image bearing member using a lubricant applicator. Any known applicators can be used, but a brush-form applicator, which is rotated while contacted with a lubricant to scrape the lubricant and which applies the scraped lubricant to the surface of the image bearing member, is preferably used.

The lubricant application process is performed after the cleaning process. Specifically, a lubricant is applied to the surface of the image bearing member, which surface has been cleaned with a cleaning device, and then the applied lubricant is spread as mentioned below.

(Lubricant Spreading Process and Lubricant Spreading Device)

In the lubricant spreading process, the lubricant applied on the surface of the image bearing member is evenly spread using a lubricant spreading device. Any known lubricant spreading devices can be used, but lubricant spreading devices having a blade serving as a lubricant spreading member are preferably used for the image forming apparatus of the present invention. The lubricant spreading member (such as blades) is preferably contacted with the surface of the image bearing member so as to counter the rotated image bearing member.

(Toner Recycling Process and Recycling Device)

In the toner recycling process, the toner particles collected in the cleaning process are fed to the developing device to be reused. The toner recycling process is performed using a known recycling device such as powder feeding devices.

(Controlling Process and Controller)

The controlling process is performed using a controller to control each of the processes mentioned above. Specific examples of the controller include sequencers, and personal computers.

(Process Cartridge)

The image bearing member, and at least one of the charging device, developing device, cleaning device, lubricant applicator, and lubricant spreading device can be unitized as a process cartridge so as to be detachably attachable to the image forming apparatus of the present invention.

Next, the first embodiment of the image forming apparatus will be explained by reference to a drawing.

FIG. 1 is a schematic view illustrating an embodiment of the image forming apparatus of the present invention.

In FIG. 1, an image forming apparatus 100A includes a photoreceptor drum 10 (hereinafter referred to as a photoreceptor) serving as an image bearing member; a charging roller 20 serving as a charging member of a charging device; a light irradiator serving as the latent image forming device emitting imagewise light L; a developing device 40 serving as an image developing device; an intermediate transfer medium 50; a cleaning blade 60 serving as a cleaning member of a cleaning device; a discharging lamp 70 serving as a discharging member of a discharging device; a lubricant application device (not shown, and explained later); and a lubricant spreading device (not shown, and explained later).

The intermediate transfer medium 50 is an endless belt which is rotated in a direction indicated by an arrow by three rollers 51 arranged therein while tightly stretched by the rollers. At least one of the three rollers 51 serves as a transfer bias roller configured to apply a transfer bias (first transfer bias) to the intermediate transfer medium 50. A cleaning device including a cleaning blade 90 is provided to clean the surface of the intermediate transfer medium 50.

In the vicinity of the intermediate transfer medium 50, a transfer roller 80 is provided to apply a transfer bias (a second transfer bias) to a receiving material 95 on which a toner image is to be transferred. In addition, a corona charger 58 is provided to charge a toner image on the intermediate transfer medium 50. The corona charger 58 is arranged at a location between the primary transfer position at which the photoreceptor 10 is contacted with the intermediate transfer medium 50 and the secondary transfer position at which the intermediate transfer medium 50 is contacted with the receiving material 95.

The developing device 40 includes a developing belt 41; a black developing unit 45K; a yellow developing unit 45Y; a magenta developing unit 45M; and a cyan developing unit 45C. Each of the developing units includes a developer containing portion 42 (42K, 42Y, 42M or 42C) containing a developer including a toner, a developing roller 44 (44K, 44Y, 44M or 44C) configured to bear and transport the developer, and a developer supplying roller 43 (43K, 43Y, 43M or 43C) configured to supply the developer in the developer containing portion 42 to the developing roller 44. The developing belt 41 is rotatably supported by plural rollers and is contacted with the photoreceptor 10.

In the image forming apparatus 100A, the surface of the photoreceptor 10 is uniformly charged with the charging roller 20. The light irradiator 30 irradiates the charged surface of the photoreceptor 10 with imagewise light to form an electrostatic latent image on the photoreceptor 10. The developing device 40 develops the latent image with color toners to sequentially form color toner images on the photoreceptor 10. The color toner images are transferred to the intermediate transfer medium 50 (first transfer) to form a combined color toner image (e.g., a full color toner image) thereon while at least one of the rollers 51 applies a transfer bias thereto. The toner image formed on the intermediate transfer medium 50 is then transferred to the receiving material 95 (second transfer). Particles of the toner remaining on the photoreceptor 10 after the transfer operation are removed with the cleaner 60 and charges remaining on the photoreceptor 10 are removed by irradiating the photoreceptor 10 with light using the discharging lamp 70.

Figure 2:
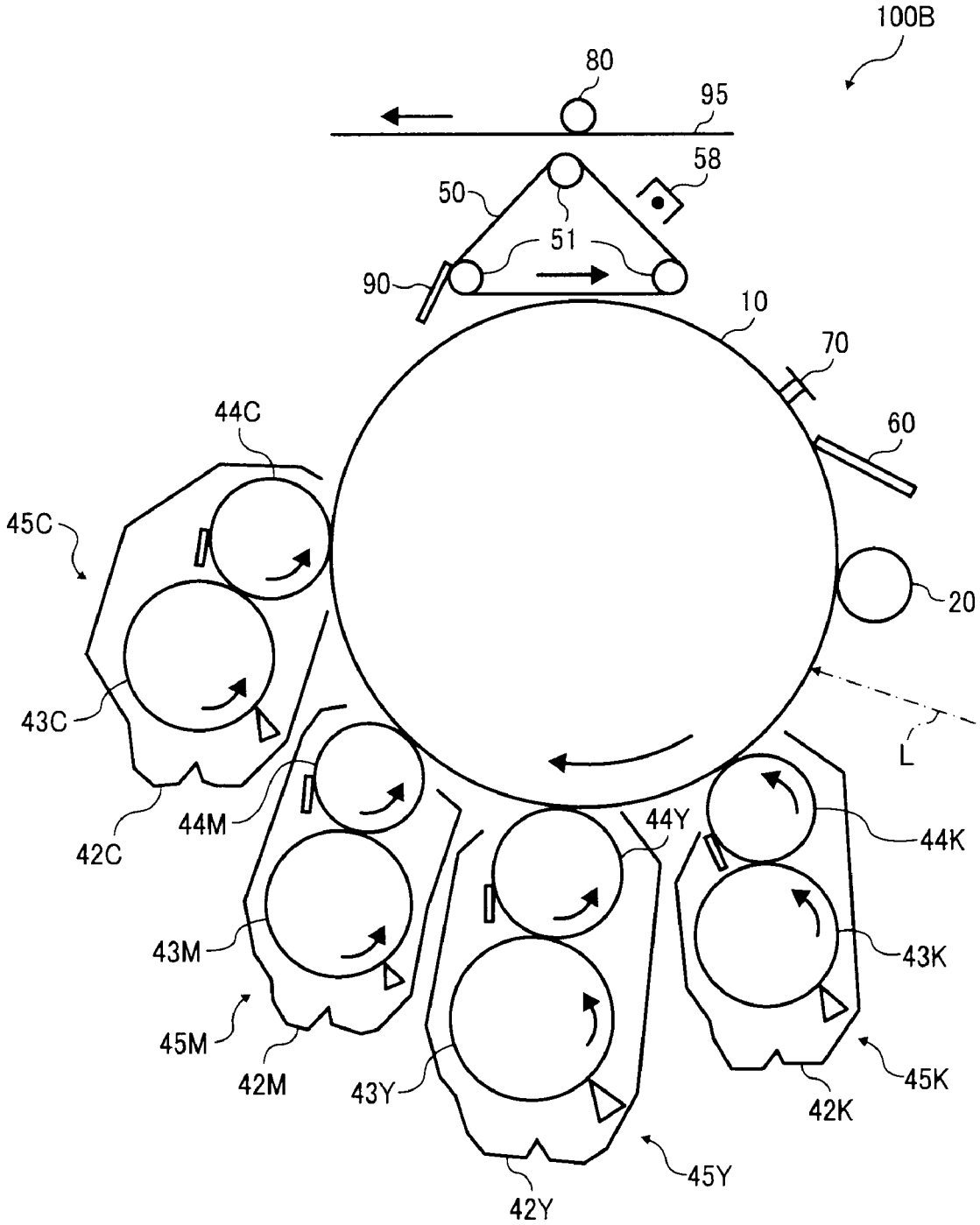
FIG. 2 is a schematic view illustrating another example of the image forming apparatus of the present invention.

A second embodiment of the image forming apparatus of the present invention is illustrated in FIG. 2. In FIG. 2, an image forming apparatus 100B has the same configuration as that of the image forming apparatus illustrated in FIG. 1 except that the black, yellow, magenta and cyan developing units 45K, 45Y, 45M and 45C face the photoreceptor 10 without using the developing belt 41. The developing roller 44 transports the developer supplied by the developer supplying roller 43 to a development region at which the developing roller faces the photoreceptor 10. The action of the image forming apparatus is substantially the same as that of the image forming apparatus illustrated in FIG. 1. In addition, the image forming apparatus includes a lubricant application device (explained later), and a lubricant spreading device (explained later), but they are not illustrated in FIG. 2.

Figure 3:
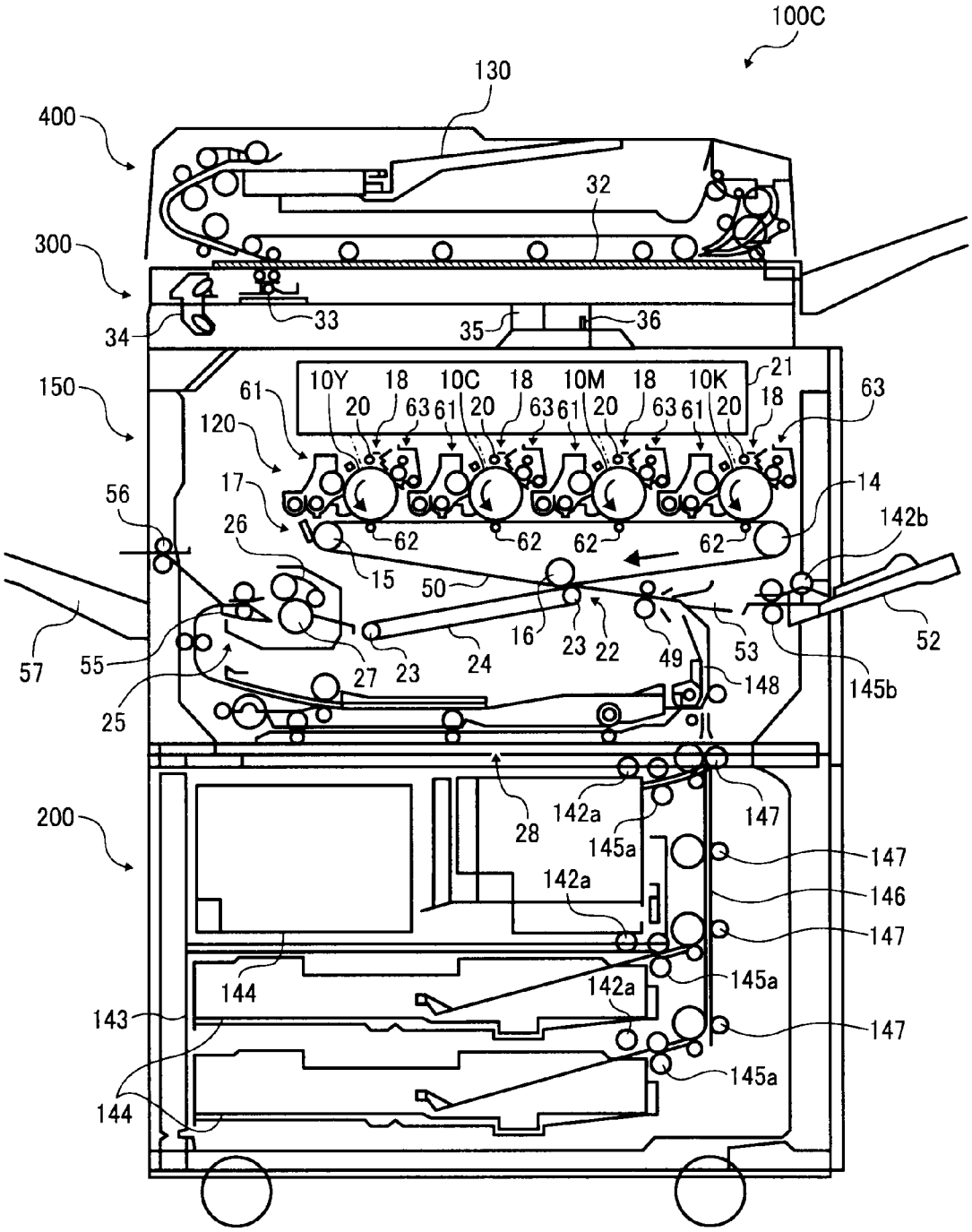
FIG. 3 is a schematic view illustrating yet another example of the image forming apparatus of the present invention.

A third embodiment of the image forming apparatus of the present invention is illustrated in FIG. 3.

FIG. 3 is the overview of the third embodiment of the image forming apparatus of the present invention, which is a tandem-type color image forming apparatus.

In FIG. 3, a tandem-type color image forming apparatus 100C includes an image forming section 150, a paper feeding section 200, a scanner 300 and an automatic document feeder 400.

The image forming section 150 includes the endless intermediate transfer medium 50, which is provided in the center of the image forming section 150. The intermediate transfer medium 50 is rotated in the clockwise direction by rollers 14, 15 and 16 while tightly stretched by the rollers. A cleaning device 17 is provided near the roller 15 to remove particles of the toner remaining on the surface of the intermediate transfer medium 50.

Four image forming units 18 for forming yellow, magenta, cyan and black toner images are arranged side by side on the intermediate transfer medium 50. The image forming units 18 include respective photoreceptors 10Y, 10M, 10C and 10K. Numeral 120 denotes a tandem type developing device. The developing device 120 includes four developing devices 61 arranged in the respective four image forming units 18. A light irradiator 21 configured to irradiate the photoreceptor with light to form an electrostatic latent image thereon is arranged over the image forming units 18.

A second transfer device 22 is provided below the intermediate transfer medium 50. The second transfer device 22 includes an endless belt 24 which is rotatably stretched a pair of rollers 23. The endless belt 24 feeds a receiving material so that the toner images (i.e., a combined color toner image) on the intermediate transfer medium 50 are transferred to the receiving material while sandwiched by the intermediate transfer medium 50 and the endless belt 24.

A fixing device 25 is arranged at a position near the second transfer device 22. The fixing device 25 includes an endless fixing belt 26 and a pressure roller 27, which presses the fixing belt 26.

In addition, a sheet reversing device 28 configured to reverse the receiving material is provided at a position near the fixing device 25, to produce double-sided copies.

Then the full color image forming operation of the tandem-type color image forming apparatus 100C will be explained.

An original to be copied is set on an original table 130 of the automatic document feeder 400. Alternatively, the original may be directly set on a glass plate 32 of the scanner 300 after the automatic document feeder 400 is opened, followed by closing of the automatic document feeder 400. When a start button (not shown) is pushed, the color image on the original on the glass plate 32 is scanned with a first traveler 33 and a second traveler 34, which move in the right direction in FIG. 3. In the case where the original is set on the table 130 of the automatic document feeder 400, at first the original is fed to the glass plate 32, and then the color image thereon is scanned with the first and second travelers 33 and 34. The first traveler 33 irradiates the color image on the original with light and the second traveler 34 reflects the light reflected from the color image to send the color light image to a sensor 36 via a focusing lens 35. Thus, color image information (i.e., black, yellow, magenta and cyan color image data) is provided.

The black, yellow, magenta and cyan color image data are sent to the respective black, yellow, magenta and cyan color image forming units 18, and black, yellow, magenta and cyan color toner images are formed on the respective photoreceptors 10K, 10Y, 10M and 10C. The toner image forming operation is the same as that mentioned in the image forming apparatus illustrated in FIG. 1.

Figure 4:
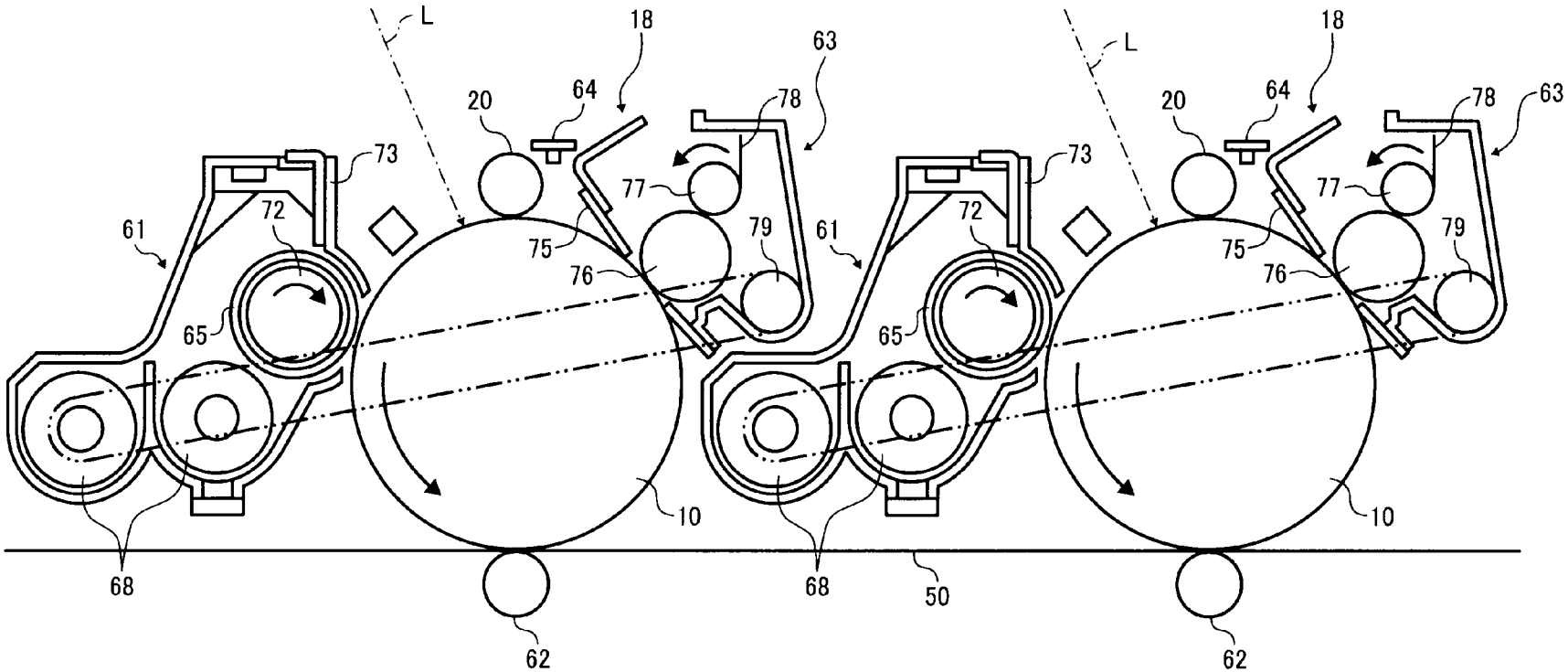
FIG. 4 is a schematic view illustrating the image forming section of the image forming apparatus illustrated in FIG. 3.

FIG. 4 is a schematic view illustrating a part of the image forming units 18.

Numeral 20, 61, 62, 63 and 64 denote the charging roller, the developing device, a transfer roller, a cleaning device and a discharging device.

The developing device 61 includes agitators 68, a developing roller 72, and a regulating blade 73 configured to form a developer layer 65 on the surface of the developing roller. Character L denotes imagewise light.

The cleaning device 63 includes a cleaning blade 75, a cleaning brush 76, a roller 77, a blade 78 and a toner recycling device 79 configured to feed the collected toner particles to the developing device 61.

Referring back to FIG. 3, the thus prepared black, yellow, magenta and cyan color toner images are transferred one by one to the intermediate transfer medium 50 which is rotated by the rollers 14, 15 and 16, resulting in formation of a full color toner image on the intermediate transfer medium 50. Numeral 62 denotes the transfer roller (transfer charger).

On the other hand, one of paper feeding rollers 142*a* is selectively rotated to feed the uppermost paper sheet of paper sheets stacked in a paper cassette 144 in a paper bank 143 while the paper sheet is separated one by one by a separation roller 145*a* when plural paper sheets are continuously fed.

The paper sheet is fed to a passage 148 in the image forming section 150 through a passage 146 in the paper feeding section 200, and is stopped once by a registration roller 49. Numeral 147 denotes feed rollers. A paper sheet can also be fed by a feeding roller 142*b* from a manual paper tray 52, and the thus fed paper sheet is fed to a passage 53 after separated one by one by a separation roller 145*b*. The thus fed paper sheet is also stopped once by the registration roller 49. The registration roller 49 is generally grounded, but a bias can be applied thereto to remove paper dust therefrom.

The full color toner image thus overlaid on the intermediate transfer medium 50 is transferred to the paper sheet, which is timely fed by the registration roller 49, at the contact point of the second transfer device 22 with the intermediate transfer medium 50. Particles of the toner remaining on the surface of the intermediate transfer medium 50 even after the second image transfer operation are removed therefrom by the cleaner 17.

The paper sheet having the full color toner image thereon is then fed by the second transfer device 22 to the fixing device 25, and the toner image is fixed on the paper sheet upon application of heat and pressure. Then the paper sheet bearing a fixed toner image thereon is discharged from the image forming section 150 by a discharge roller 56 while the path is properly selected by a paper path changing pick 55. Thus, a copy is stacked on a tray 57. When a double sided copy is produced, the paper sheet having a toner image on one side thereof is fed to the sheet reversing device 28 to be reversed. The paper sheet is then fed to the second transfer device 24 so that an image is transferred to the other side of the paper sheet. The second image formed on the other side is also fixed by the fixing device 25 and then the double-sided copy is discharged to the tray 57 by the discharge roller 56.

The image forming apparatus 100C also includes a lubricant application device and a lubricant spreading device, which are not shown and which are mentioned below.

Figure 5:
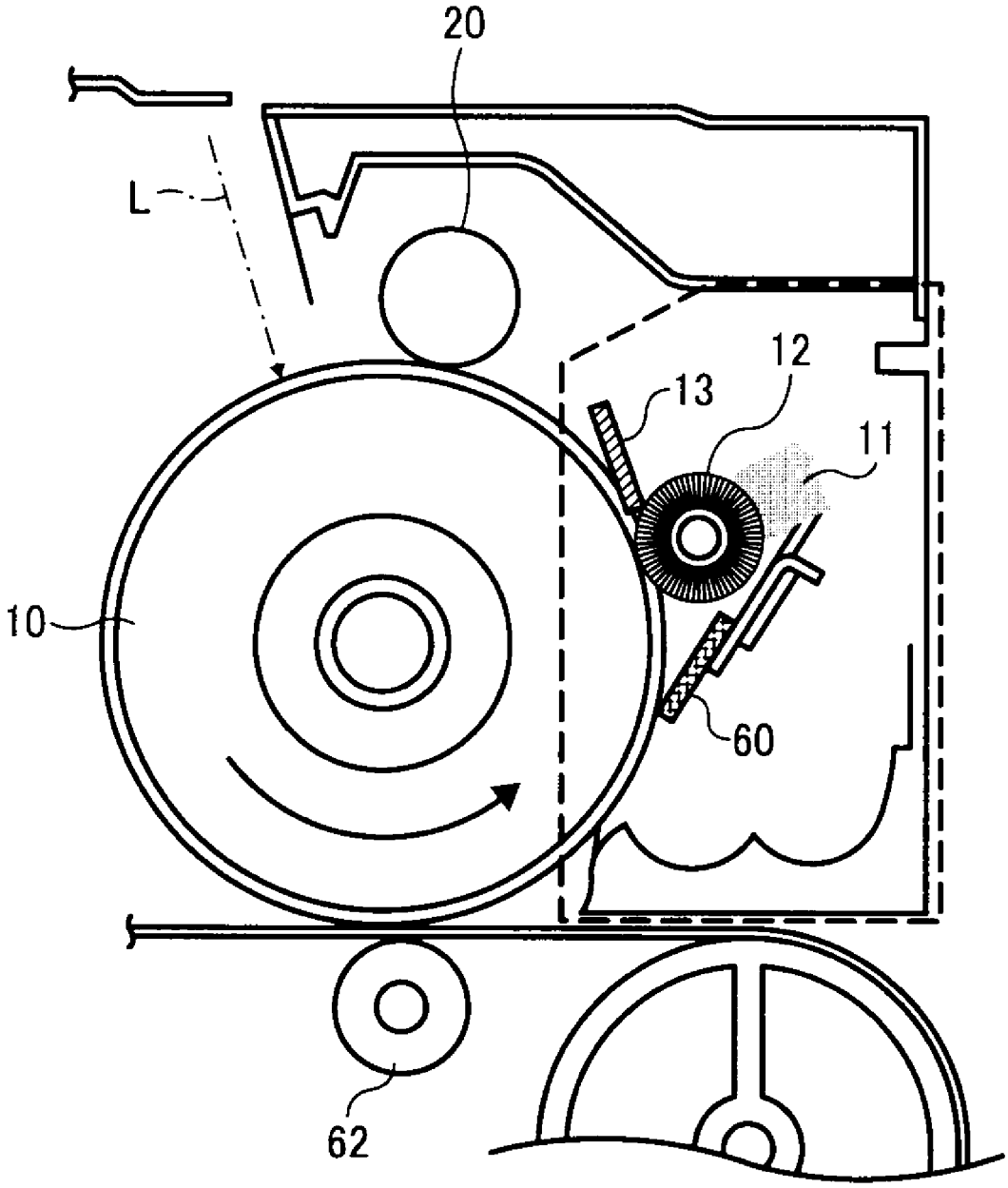
FIG. 5 is a schematic view illustrating a lubricant applying device and a lubricant spreading device for use in the image forming apparatus of the present invention.

FIG. 5 illustrates a lubricant application device and a lubricant spreading device for use in the image forming apparatus of the present invention.

Referring to FIG. 5, a lubricant application device including a lubricant applying member 12 configured to apply a lubricant 11 to the surface of the photoreceptor 10 is provided on a downstream side from the cleaning blade 60 configured to clean the surface of the photoreceptor 10 relative to the rotation direction of the image bearing member indicated by an arrow. In addition, a lubricant spreading device including a lubricant spreading member 13 is provided on a downstream side from the lubricant applying member 12.

Referring to FIG. 5, a toner image, which is formed on the photoreceptor 10 using the charging roller 20, imagewise light L and developing device (not shown), is transferred to an intermediate transfer medium by the transfer member 62 applying a bias to the intermediate transfer medium. Toner particles and foreign materials remaining on the photoreceptor 10 even after the primary transfer operation are removed therefrom by the cleaning blade 60.

The lubricant applying member 12, which is rotated by a driving device (not shown), scrapes the lubricant 11, which is pressure-contacted with the lubricant applying member 12. The scraped lubricant is applied to the surface of the photoreceptor 10 by the rotated lubricant applying member 12. The thus applied lubricant is spread by the lubricant spreading member 13, which is contacted with the photoreceptor 10 so as to counter the photoreceptor. Thus, the lubricant 11 is evenly applied to the surface of the photoreceptor 10, and thereby the adhesiveness of the toner to the photoreceptor can be reduced, resulting in prevention of the filming problem.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The external additives A-H used for Examples 1-2 and Comparative Examples 1-6 are as follows.

A: Hydrophobic silica having a BET specific surface area of 140 $m^2/g$ and a hydrophobicity of 71%.

B: Hydrophobic silica having a BET specific surface area of 90 $m^2/g$ and a hydrophobicity of 65%.

C: Hydrophobic silica having a BET specific surface area of 140 $m^2/g$ and a hydrophobicity of 45%.

D: Hydrophobic titanium oxide having a BET specific surface area of 68 $m^2/g$ and a hydrophobic degree of 61%.

E: Hydrophobic titanium oxide having a BET specific surface area of 30 $m^2/g$ and a hydrophobicity of 60%.

F: Hydrophobic silica having a BET specific surface area of 35 $m^2/g$ and a hydrophobicity of 76%.

G: Hydrophobic silica having a BET specific surface area of 12 $m^2/g$ and a hydrophobicity of 67%.

H: Hydrophobic silica having a BET specific surface area of 28 $m^2/g$ and a hydrophobicity of 69%.

Example 1

(Preparation of Unmodified Polyester Resin)

The following components were contained in a reaction vessel equipped with a condenser, a stirrer and a nitrogen feed pipe to perform a polycondensation reaction for 8 hours at 230° C. under normal pressure.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

The reaction was further performed for 5 hours under a reduced pressure of from 10 to 15 mmHg (1.33 to 2.00 Pa).

Further, 44 parts of trimellitic anhydride was added to the vessel and the mixture was reacted for 2 hours at 180° C. under normal pressure. Thus, an unmodified polyester resin (1) was prepared. It was confirmed that the unmodified polyester resin (1) has a number average molecular weight of 2,500, a weight average molecular weight of 6,700, a glass transition temperature (Tg) of 43° C. and an acid value of 25 mgKOH/g.

(Preparation of Master Batch)

The following components were mixed using a HENSCHEL MIXER mixer from Mitsui Mining Co., Ltd.

| | |
|---|---|
| Water | 1200 parts |
| Carbon black (PRINTEX 35 from Degussa A.G. having DBP oil absorption of 42 ml/100 g and pH of 9.5) | 540 parts |
| Unmodified polyester resin prepare above | 1200 parts |

The mixture was kneaded for 30 minutes at 150° C. using a two roll mill. Then the kneaded mixture was cooled by rolling, followed by pulverization using a pulverizer from Hosokawa Micron Corp. Thus, a master batch (1) was prepared.

(Preparation of Wax Dispersion)

In a reaction vessel equipped with a stirrer and a thermometer, 378 parts of the unmodified polyester resin (1), 110 parts of a carnauba wax, 22 parts of a charge controlling agent (E-84, a metal complex of salicylic acid, from Orient Chemical Industries Co., Ltd.), and 947 parts of ethyl acetate were mixed and the mixture was heated to 80° C. while agitated. After the mixture was heated at 80° C. for 5 hours, the mixture was cooled to 30° C. over 1 hour. Then 500 parts of the master batch (1) and 500 parts of ethyl acetate were added to the vessel, and the mixture was agitated for 1 hour to prepare a raw material dispersion (1).

Then 1,324 parts of the raw material dispersion (1) was subjected to a dispersing treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Thus, a wax dispersion (1) in which the carbon black and carnauba wax are dispersed was prepared.

(Preparation of Toner Constituent Dispersion)

Then 1,324 parts of a 65% by weight ethyl acetate solution of the unmodified polyester resin (1) prepared above was added to the wax dispersion. The mixture was subjected to the dispersion treatment using the bead mill. The dispersion conditions are the same as those mentioned above except that the dispersion operation was performed once (i.e., one pass).

Then 200 parts of the thus prepared dispersion was mixed with 3 parts of a modified layered montmorillonite (CLAYTON APA from Southern Clay Products), in which at least part of interlayer ions is modified with a quaternary ammonium salt having a benzyl group. The mixture was agitated for 30 minutes with a TK HOMODISPER from Tokushu Kika Kogyo Co., Ltd. Thus, a toner constituent dispersion (1) was prepared.

The viscosity of the thus prepared toner constituent dispersion (1) was measured with a parallel plate type rheometer, AR2000 (from DA Instrument Japan) having parallel plates with a diameter of 20 mm. The measuring method is as follows.

At first, a shear force is applied for 30 seconds to the toner constituent dispersion under the following conditions:

Gap between parallel plates: 30 μm

Temperature of the dispersion: 25° C.

Shear velocity: 30,000 $sec^{-1}$

Next, the shear velocity is changed from 0 to 70 $sec^{-1}$ over 20 seconds to determine the viscosity (i.e., viscosity A) of the toner constituent dispersion. In addition, after a shear force is applied for 30 seconds to the toner constituent dispersion under the conditions of 25° C. in temperature and 30,000 $sec^{-1}$ in shear velocity, the viscosity (i.e., viscosity B) of the toner constituent dispersion is measured.

(Synthesis of Intermediate Polyester)

The following components were contained in a reaction vessel equipped with a condenser, a stirrer, and a nitrogen feed pipe, and reacted for 8 hours at 230° C. under normal pressure.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyltin oxide | 2 parts |

The reaction was further performed for 5 hours under a reduced pressure of from 10 to 15 mmHg (1.33 to 2.00 Pa).

Thus, an intermediate polyester was prepared. It was confirmed that the intermediate polyester has a number average molecular weight of 2,100, a weight average molecular weight of 9,500, a glass transition temperature of 55° C., an acid value of 0.5 mgKOH/g and a hydroxyl value of 51 mgKOH/g.

(Preparation of Prepolymer)

Next, the following components were contained in a reaction vessel equipped with a condenser, a stirrer, and a nitrogen feed pipe to be reacted for 5 hours at 100° C.

| | |
|---|---|
| Intermediate polyester | 410 parts |
| Isophorone diisocyanate | 89 parts |
| Ethyl acetate | 500 parts |

Thus, a prepolymer (1) was prepared. The prepolymer (1) included isocyanate groups in an amount of 1.53% by weight.

(Preparation of Oil Phase Liquid)

In a reaction vessel equipped with a stirrer and a thermometer, 170 parts of isophorone diamine and 75 parts of methyl ethyl ketone were mixed and reacted for 5 hours at 50° C. to prepare a ketimine compound. The ketimine compound has an amine value of 418 mgKOH/g.

In a reaction vessel, 749 parts of the toner constituent dispersion (1), 115 parts of the prepolymer (1) and 2.9 parts of the ketimine compound were mixed for 1 minute using a TK HOMOMIXER, in which the rotor was rotated at a revolution of 5,000 rpm. Thus, an oil phase liquid (i.e., a toner component liquid) (1) was prepared.

(Preparation of Particulate Resin Dispersion)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were mixed. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% by weight aqueous solution of ammonium persulfate was added thereto, and the mixture was aged for 5 hours at 75° C. Thus, an aqueous particulate resin dispersion was prepared.

In this regard, the particle diameter and particle diameter distribution of solid components in a toner constituent dispersion or a toner component liquid were determined using an instrument MICROTRACK UPA-150 (from Nikkiso Co., Ltd.) and a software MICROTRACK PARTICLE SIZE ANALYZER Ver. 10.1.2-016EE (from Nikkiso Co., Ltd.). Specifically, the procedure is as follows.

(1) a sample is fed into 30 ml of a glass container;

(2) the solvent used for preparing the toner constituent dispersion or the toner component liquid was added thereto to prepare a dispersion having a solid content of 10% by weight;

(3) the dispersion is subjected to a dispersion treatment for 2 minutes using an ultrasonic dispersing machine W-113MK-II from Honda Electronics Co., Ltd.;

(4) the background of the instrument is measured by feeding the solvent used for preparing the toner constituent dispersion;

(5) the dispersion prepared in paragraph (4) is dropped thereinto until the value of sample loading ranges from 1 to 10; and (6) measurement is performed.

It is preferable to control the value of sample loading so as to fall in the range of from 1 to 10. In order to control the value of sample loading, the added amount of the dispersion should be controlled.

The measurement and analysis conditions are as follows.

Display of distribution: volume distribution

Selection of particle diameter ranges: standard

Number of channels: 44

Measuring time: 60 sec

Repeat number: 1

Transparency of particle: transparent

Refractive index of particle: 1.5

Shape of particle: non-spherical

Density of particle: 1 g/cm$^3$

Since refractive indexes of various solvents are listed in "Guideline for measuring conditions" from Nikkiso Co., Ltd., the refractive index described therein is used for the solvent used for the toner constituent dispersion of the toner component liquid.

(Preparation of Dispersion Slurry)

In a reaction vessel equipped with a stirrer, 990 parts of water, 83 parts of the particulate resin dispersion prepared above, 37 parts of an aqueous solution of a sodium salt of dodecyldiphenyletherdisulfonic acid (ELEMINOL MON-7 from Sanyo Chemical Industries Ltd., solid content of 48.5%), 135 parts of a 1% by weight aqueous solution of a carboxymethyl cellulose sodium salt (CELLOGEN BS-H-3 from Dai-ichi Kogyo Seiyaku Co., Ltd., serving a polymer dispersant), and 90 parts of ethyl acetate were mixed while agitated. Thus, an aqueous medium was prepared.

Next, 867 parts of the oil phase liquid was added to 1,200 parts of the aqueous medium, and the mixture was agitated for 20 minutes using a TK HOMOMIXER mixer in which the rotor was rotated at a revolution of 13,000 rpm. Thus, an emulsion slurry (1) was prepared.

Further, the emulsion slurry (1) was fed to a reaction vessel equipped with a stirrer and a thermometer and heated for 8 hours at 30° C. to remove the solvent therefrom. The resultant dispersion was aged for 4 hours at 45° C. Thus, a dispersion slurry (1) was prepared.

(Preparation of Toner)

One hundred (100) parts of the dispersion slurry (1) was filtered under a reduced pressure.

Then the wet cake was mixed with 100 parts of ion-exchange water and the mixture was agitated for 10 minutes with a TK HOMOMIXER mixer at a revolution of 12,000 rpm, followed by filtering. Thus, a wet cake (a) was prepared.

The thus prepared wet cake (a) was mixed with 100 parts of a 10% hydrochloric acid so as to have a pH of 2.8, and the mixture was agitated for 10 minutes with TK HOMOMIXER at a revolution of 12,000 rpm, followed by filtering. Thus, a wet cake (b) was prepared.

Then the wet cake (b) was mixed with 300 parts of ion-exchange water and the mixture was agitated for 10 minutes with TK HOMOMIXER at a revolution of 12,000 rpm, followed by filtering. This operation was repeated twice. Thus, a final wet cake was prepared.

The final wet cake was dried for 48 hours at 45° C. using a circulating air drier, followed by sieving with a screen having openings of 75 μm.

Thus, black toner particles were prepared.

One hundred (100) parts of the toner particles were mixed with 1.5 parts of the external additive F, 0.8 parts of the external additive D and 0.9 parts of the external additive A, and the mixture was agitated for 7 minutes by a HENSCHEL MIXER mixer (from Mitsui Mining Co., Ltd.), which was rotated at a peripheral speed of 33 m/s. Further, the mixture was filtered with a 500-mesh screen to remove coarse particles therefrom. Thus, a toner was prepared.

The image quality of the toner was evaluated as follows.

1. The toner is allowed to settle in a room in which the temperature and humidity are controlled at 25° C. and 50% RH.
2. The toner included in the developer contained in a process cartridge of an image forming apparatus A is removed therefrom so that only the carrier is contained in the process cartridge. In this regard, the image forming apparatus A has a charging device applying an AC voltage with a frequency of 7.3 cycle/mm and a photoreceptor rotatable at a linear speed of 300 mm/sec, and performs a lubricant application process and a lubricant spreading process after the cleaning process.
3. Twenty eight (28) grams of the black toner prepared above is fed to the developing device of the process cartridge to be mixed with the carrier prepared in paragraph 2 above to prepare 400 grams of a developer having a toner concentration of 7% by weight.
4. The process cartridge is set to the image forming apparatus A, and the developing device is idled for 5 minutes while rotating the developing sleeve at a linear speed of 300 mm/s.
5. The developing sleeve and the photoreceptor are rotated in a trailing manner at the respective target linear speeds. In this regard, the potential of the charged photoreceptor and the development bias are controlled such that the toner image formed on the photoreceptor has a weight of 0.6±0.05 mg/cm$^2$.
6. Only one cleaning blade, which is the cleaning blade used for a process cartridge of an image forming apparatus, IMAGIO NEO C600, is used. The cleaning blade has an elastic modulus of 70%, and a thickness of 2 mm, and is contacted with the photoreceptor at a contact angle of 20° so as to counter the photoreceptor.
7. The current of the transfer bias is controlled such that the transfer rate of the toner image is 96±2%.
8. A running test in which 1000 copies of an original image having a black solid image having a length of 4 cm (in the feeding direction of the original image) and a width of 25 cm are produced is performed.
9. The 10$^{th}$ image and the 1000$^{th}$ image are visually observed to determine the image qualities of the images (such as image density and formation of abnormal images (e.g., streak images and uneven density). The image qualities are graded as follows:

◎: Excellent

○: Good

Δ: Slightly bad

×: Bad

Example 2

The procedure for preparation and evaluation of the toner in Example 1 was repeated except that the external additive F was replaced with the external additive H and the image forming apparatus A used for evaluation was changed to an image forming apparatus B, which has a charging device applying a combination of a DC voltage and an AC voltage with a frequency of 6.9 cycle/mm and a photoreceptor rotatable at a linear speed of 350 mm/sec, and performs the above-mentioned lubricant application process and lubricant spreading process after the cleaning process.

Example 3

The procedure for preparation and evaluation of the toner in Example 1 was repeated except that the frequency of the AC voltage applied by the charger was changed from 7.3 cycle/mm to 8.3 cycle/mm and the external additive mixing process was changed as follows. Specifically, at first, 1.5 parts of the external additive F was added to 100 parts of the toner particles, and the mixture was agitated for 5 minutes by a 20-litter HENSCHEL MIXER mixer (from Mitsui Mining Co., Ltd.), which was rotated at a peripheral speed of 33 m/s. Next, 0.8 parts of the external additive D was added to the mixture, and the mixture was agitated for 4 minutes by the HENSCHEL MIXER mixer, which was rotated at a peripheral speed of 33 m/s. Further, 0.9 parts of the external additive A was added to the mixture, and the mixture was agitated for 4 minutes by the HENSCHEL MIXER mixer, which was rotated at a peripheral speed of 28 m/s.

Example 4

The procedure for preparation and evaluation of the toner in Example 1 was repeated except that the image forming apparatus A used for evaluation was changed to an image forming apparatus E, which has a charging device applying a combination of a DC voltage and an AC voltage with a frequency of 7.5 cycle/mm and a photoreceptor rotatable at a linear speed of 260 mm/sec, and performs the above-mentioned lubricant application process and lubricant spreading process after the cleaning process.

Comparative Example 1

The procedure for preparation and evaluation of the toner in Example 1 was repeated except that the external additive F was not added.

Comparative Example 2

The procedure for preparation and evaluation of the toner in Example 1 was repeated except that the external additive A was replaced with the external additive B.

Comparative Example 3

The procedure for preparation and evaluation of the toner in Example 1 was repeated except that the external additive D was replaced with the external additive E.

Comparative Example 4

The procedure for preparation and evaluation of the toner in Example 1 was repeated except that the external additive F was replaced with the external additive G.

Comparative Example 5

The procedure for preparation and evaluation of the toner in Example 1 was repeated except that the image forming apparatus A used for evaluation was changed to an image forming apparatus C, which has a charging device applying a combination of a DC voltage and an AC voltage with a frequency of 9.1 cycle/mm and a photoreceptor rotatable at a linear speed of 230 mm/sec, and performs only the above-mentioned lubricant application process after the cleaning process without performing the lubricant spreading process.

Comparative Example 6

The procedure for preparation and evaluation of the toner in Example 1 was repeated except that the image forming apparatus A used for evaluation was changed to an image forming apparatus D, which has a charging device applying a combination of a DC voltage and an AC voltage with a frequency of 6.1 cycle/mm and a photoreceptor rotatable at a linear speed of 260 mm/sec, and performs only the above-mentioned lubricant application process after the cleaning process without performing the lubricant spreading process.

The evaluation results are shown in Table 1.

| | Image quality | |
|---|---|---|
| | $10^{th}$ image | $1,000^{th}$ image |
| Example 1 | ○ | ○ |
| Example 2 | ◎ | ◎ |
| Example 3 | ◎ | ○ |
| Example 4 | ◎ | ○ |
| Comp. Example 1 | Δ | Δ |
| Comp. Example 2 | Δ | X |
| Comp. Example 3 | ○ | X |
| Comp. Example 4 | ○ | X |
| Comp. Example 5 | Δ | X |
| Comp. Example 6 | Δ | X |

It is clear from Table 1 that the toner, and image forming method and apparatus of the present invention can produce high quality images over a long period of time without causing the filming problem and deteriorating the chargeability of the carrier.

This document claims priority and contains subject matter related to Japanese Patent Applications Nos. 2007-311280 and 2008-260335, filed on Nov. 30, 2007, and Oct. 7, 2008, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming method comprising:

charging a rotating image bearing member with a non-contact AC charging member applying a combination of a DC voltage and an AC voltage with a frequency of from 6.5 to 8.5 cycle/mm;

irradiating the charged image bearing member with light to form an electrostatic latent image on the image bearing member;

developing the electrostatic latent image with a developer including a toner to form a toner image on the image bearing member;

transferring the toner image onto a receiving material optionally via an intermediate transfer medium;

fixing the toner image on the receiving material;

cleaning a surface of the image bearing member with a blade;

applying a lubricant to the surface of the image bearing member after cleaning the surface of the image bearing member; and spreading the lubricant on the surface of the image bearing member with a spreading member which is set on the image bearing member so as to counter the rotating image bearing member, wherein the toner includes:

toner particles, and three kinds of external additives, which are present on a surface of the toner particles and consist of:

a first particulate hydrophobic silica having a BET specific surface area of from 20 to 40 $m^2/g$;

a particulate hydrophobic titanium oxide having a BET specific surface area of from 40 to 80 $m^2/g$; and a second particulate hydrophobic silica having a BET specific surface area of from 130 to 300 $m^2/g$.

2. The image forming method according to claim 1, wherein the charging, light irradiating, developing and transferring steps are performed while rotating the image bearing member at a linear speed of not lower than 300 mm/sec.

3. The image forming method according to claim 1, wherein the toner particles are prepared by a method including:

dispersing a toner component liquid including at least a binder resin, a colorant and a particulate layered inorganic material, in which at least part of interlayer ions thereof is modified with an organic ion, in an aqueous medium to prepare a dispersion or an emulsion.

4. The image forming method according to claim 1, wherein the toner particles are prepared by a method including:

dispersing a toner component liquid including at least a first binder resin, a binder resin precursor, a compound capable of inducing at least a polymer chain growth reaction or a crosslinking reaction together with the binder resin precursor, a colorant and a particulate layered inorganic material, in which at least part of interlayer ions thereof is modified with an organic ion, in an aqueous medium to prepare a dispersion or an emulsion; and subjecting the dispersion or emulsion to at least a polymer chain growth reaction or a crosslinking reaction to prepare the toner particles.

5. The image forming method according to claim 1, wherein each of the three kinds of external additives has a hydrophobicity of from 50 to 90%.

6. The image forming method according to claim 1, wherein the three kinds of external additives, which are present on the surface of the toner particles include:

the first particulate hydrophobic silica having a BET specific surface area of from 25 to 35 $m^2/g$;

the particulate hydrophobic titanium oxide having a BET specific surface area of from 50 to 75 $m^2/g$; and the second particulate hydrophobic silica having a BET specific surface area of from 140 to 250 $m^2/g$.

7. The image forming method according to claim 1, wherein the applying the lubricant to the surface of the image bearing member includes applying the lubricant with a rotatable lubricant applying member after cleaning the surface of the image bearing member, the rotatable lubricant applying member being located between the blade and the spreading member and downstream in a rotation direction of the image bearing member from the blade.

* * * * *